US008545274B2

(12) United States Patent
Purkis et al.

(10) Patent No.: US 8,545,274 B2
(45) Date of Patent: Oct. 1, 2013

(54) FILTERING ASSEMBLY AND MODULAR JACK USING SAME

(75) Inventors: Timothy E. Purkis, Naperville, IL (US); Kirk B. Peloza, Naperville, IL (US); Johnny Chen, Danville, CA (US); Eliza Conant, Beijing (CN)

(73) Assignee: Molex Incorporated, Lisle, IL (US)

( * ) Notice: Subject to any disclaimer, the term of this patent is extended or adjusted under 35 U.S.C. 154(b) by 116 days.

(21) Appl. No.: 13/309,170

(22) Filed: Dec. 1, 2011

(65) Prior Publication Data

US 2012/0309236 A1 Dec. 6, 2012

Related U.S. Application Data

(60) Provisional application No. 61/419,230, filed on Dec. 2, 2010, provisional application No. 61/434,166, filed on Jan. 19, 2011, provisional application No. 61/498,848, filed on Jun. 20, 2011.

(51) Int. Cl.
*H01R 13/625* (2006.01)

(52) U.S. Cl.
USPC ..... 439/668

(58) Field of Classification Search
USPC ..... 439/668, 669, 676, 541.5, 953–954, 439/620.11, 620.29, 884, 55, 79
See application file for complete search history.

(56) References Cited

U.S. PATENT DOCUMENTS 5,476,394 A 12/1995 Sugihara et al.
6,227,911 B1 5/2001 Boutros et al.
6,511,348 B1 * 1/2003 Wojtacki et al. ..... 439/620.18
6,585,540 B2 7/2003 Gutierrez et al.
6,945,820 B1 9/2005 Blichasz et al.
7,153,158 B1 12/2006 Lee
7,241,181 B2 7/2007 Machado et al.
7,314,387 B1 1/2008 Liu
7,351,083 B2 4/2008 Biddle et al.
7,367,851 B2 5/2008 Machado et al.
7,510,441 B2 3/2009 Zhang et al.
7,661,994 B2 2/2010 Machado et al.
7,670,183 B2 3/2010 Huang et al.
7,712,941 B2 5/2010 Tai et al.
7,717,749 B2 5/2010 Chen et al.
7,736,176 B2 6/2010 Zhang et al.
7,786,009 B2 8/2010 Machado et al.
7,798,832 B2 * 9/2010 Qin et al. ..... 439/188
7,819,699 B2 10/2010 Xu et al.
8,206,019 B2 6/2012 Chen et al.
8,206,183 B2 6/2012 Machado et al.
8,287,316 B2 * 10/2012 Pepe et al. ..... 439/676
2002/0068484 A1 6/2002 Gutierrez et al.
2003/0100225 A1 5/2003 Aeschbacher et al.
2003/0211782 A1 11/2003 Esparaz et al.
2004/0132342 A1 7/2004 Lien
2008/0220656 A1 * 9/2008 Zhang et al. ..... 439/668
2008/0280499 A1 * 11/2008 Miki et al. ..... 439/668
2009/0098766 A1 4/2009 Steinke et al.
2009/0124135 A1 * 5/2009 Zhuang ..... 439/668
2009/0176408 A1 7/2009 Wu
2009/0243757 A1 10/2009 Xu et al.
2009/0253299 A1 10/2009 Zhang et al.
2010/0015852 A1 1/2010 Xu et al.

(Continued)

*Primary Examiner* — Jean F Duverne
(74) *Attorney, Agent, or Firm* — Stephen L. Sheldon

(57) ABSTRACT

A magnetic jack assembly includes a housing, circuit boards, shields and various filtering components. Multiple aspects of the assembly enhance manufacturability and facilitate automated manufacturing.

27 Claims, 28 Drawing Sheets

(56) References Cited

U.S. PATENT DOCUMENTS

2011/0053418 A1 3/2011 Margulis et al.
2011/0053428 A1* 3/2011 Pepe et al. ..... 439/668
2012/0142199 A1* 6/2012 Purkis et al. ..... 439/39
2012/0309233 A1 12/2012 O'Malley et al.
2012/0309236 A1 12/2012 Purkis et al.
2012/0315794 A1 12/2012 Chen et al.
2012/0322309 A1 12/2012 Xu et al.

* cited by examiner

FILTERING ASSEMBLY AND MODULAR JACK USING SAME

CROSS-REFERENCE TO RELATED APPLICATIONS

This patent application claims the benefit of U.S. Provisional Patent Application No. 61/419,230, filed Dec. 2, 2010; U.S. Provisional Patent Application No. 61/434,166, filed Jan. 19, 2011; and U.S. Provisional Patent Application No. 61/498,848, filed Jun. 20, 2011, all of which are incorporated herein by reference in their entirety.

BACKGROUND

The present disclosure relates generally to modular telecommunications jacks and, more particularly, to a high data rate capable magnetic jack.

As is known, a connector with a receptacle configured to receive a plug connector mounted on the end of a cable can be provided. One popular configuration is the receptacle (or port) configured to receive an eight position eight contact (8P8C) module plug. It is noted that the 8P8C plug is often referred to as an RJ45 plug connector (even if the 8P8C plug technically may not be a true RJ45 connector). For purpose of being compatible with popular usage, therefore, this known interface will be referred to as a RJ45 interface herein.

RJ45 compatible modular jack receptacle connectors mounted to printed circuit boards are well known in the telecommunications industry. When used as Ethernet connectors, modular jacks generally receive an input signal from one electrical device and then communicate a corresponding output signal to a second device coupled thereto. Magnetic circuitry can be used to provide conditioning and isolation of the signals as they pass from the first device to the second and typically such circuitry uses components such as a transformer and a choke. The transformer often is toroidal in shape and includes primary and secondary windings coupled together and wrapped around the toroid so as to provide magnetic coupling between the primary and secondary circuits while ensuring electrical isolation. Chokes are also commonly used to filter out unwanted noise, such as common-mode noise, and can be toroidal ferrite designs used in differential signaling applications. Modular jacks having such magnetic circuitry are typically referred to in the trade as magnetic jacks.

Existing magnetic jacks, while helpful, suffer from certain manufacturing constraints. Typically the transformer is hand-wound with thin wires (often 34 gauge or smaller) and it is possible to damage the wires during handling. Furthermore, as data rates increase (10 Gbps uses PAM-16 encoding at 650 Mhz, for example), variations in the winding can cause significant variations in performance. In addition to the performance issues, the small size of the transformer and choke makes inspection difficult and handling awkward. A design that is more suitable for automated assembly would be desirable.

The foregoing background discussion is intended solely to aid the reader. It is not intended to limit the innovations described herein nor to limit or expand the prior art discussed. Thus, the foregoing discussion should not be taken to indicate that any particular element of a prior system is unsuitable for use with the innovations described herein, nor is it intended to indicate any element, including solving the motivating problem, to be essential in implementing the innovations described herein. The implementations and application of the innovations described herein are defined by the appended claims.

SUMMARY

A magnetic jack assembly includes a housing and various filtering components. Multiple aspects of the assembly enhance manufacturability and facilitate automated manufacturing and may be used together or separately. In one aspect, a filtering assembly includes at least one sub-assembly manufactured in an automated manner. In another aspect, a pair of filtering sub-assemblies each include separate conductors that are electrically connected. In another aspect, the separate conductors are electrically connected to terminals of the filtering assembly. In another aspect, the filtering assemblies include recesses to accommodate windings around a core. In another aspect, conductors are retained in a slot and soldered to terminals. In another aspect, an electrical connector includes a base member with a plurality of carriers assemblies that each include filtering assemblies electrically connected to a plurality of contact circuit board corresponding to receptacles of the connector. In another aspect, the carriers include filtering assemblies on oppositely facing walls with the contact circuit boards being electrically connected to the filtering assemblies of adjacent carriers. In another aspect, the connector further includes center walls between the filtering assemblies mounted on the carriers. In another aspect, a jack includes a plurality of filtering assemblies, each having a housing, associated with each port of the jack. In another aspect, each of the filtering assemblies includes a signal pair and a centertap. In another aspect, the jack has a plurality of compliant pins for electrical connection with a system circuit board. In another aspect, a jack includes a mounting circuit board electrically connected to contact circuit boards by a plurality of filtering assemblies. The connections between the filtering assemblies and the boards being compliant pins. In another aspect, the cores of the filtering assemblies have at least one flat surface. In another aspect, a bridging member on the carrier electrically connects terminals of adjacent filtering assemblies.

BRIEF DESCRIPTION THE DRAWINGS

Various other objects, features and attendant advantages will become more fully appreciated as the same becomes better understood when considered in conjunction with the accompanying drawings in which like reference characters designate the same or similar parts throughout the several views, and in which.

DETAILED DESCRIPTION OF THE ILLUSTRATED EMBODIMENTS

The following description is intended to convey the operation of exemplary embodiments of the invention to those skilled in the art. It will be appreciated that this description is intended to aid the reader, not to limit the invention. As such, references to a feature or aspect are intended to describe a feature or aspect of an embodiment of the invention, not to imply that every embodiment of the invention must have the described characteristic. Furthermore, it should be noted that the depicted detailed description illustrates a number of features. While certain features have been combined together to illustrate potential system designs, those features may also be used in other combinations not expressly disclosed. Thus, the depicted combinations are not intended to be limiting unless otherwise noted.

Figure 1:
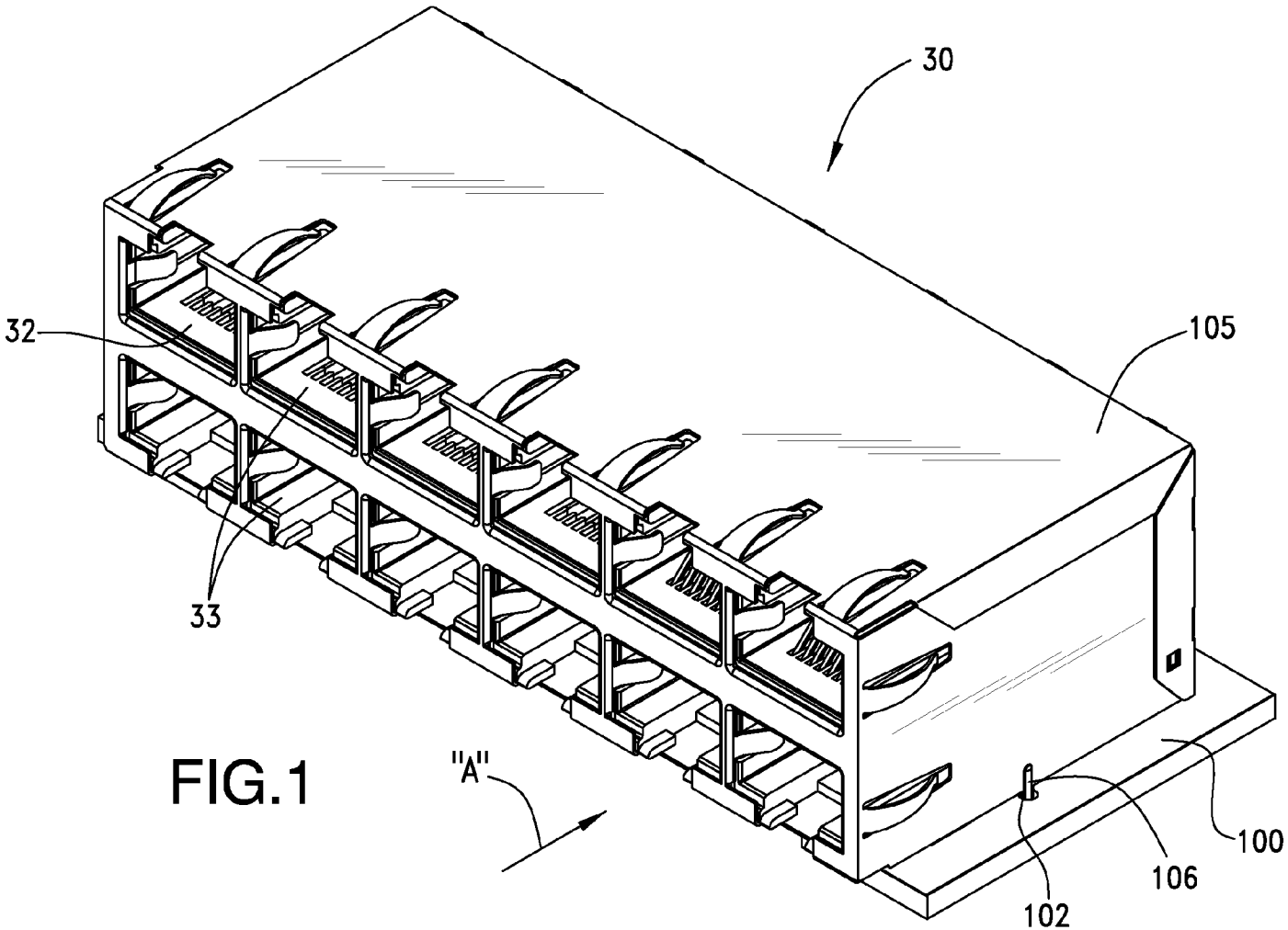
FIG. 1 is a front perspective view of a multi-port magnetic jack.

Referring to FIG. 1, a multiple input, magnetic stacked jack 30 mounted on system circuit board 100 has a housing 32 made of an insulating material such as synthetic resin (for example, PBT) and includes openings or ports 33 arranged in vertically aligned pairs (so as to provide columns of upper and lower ports). Each port is configured to receive an Ethernet or RJ-45 type jack (not shown) inserted therein in a mating direction "A." A metal or another type of conductive shield member 105 surrounds the magnetic jack housing 32 for RF and EMI shielding purposes as well for providing a ground reference.

It should be noted that in this description, representations of directions such as up, down, left, right, front, rear, and the like, used for explaining the structure and movement of each part of the disclosed embodiment are not intended to be absolute, but rather are relative. These representations are appropriate when each part of the disclosed embodiment is in the position shown in the figures. If the position or frame of reference of the disclosed embodiment changes, however, these representations are to be changed according to the change in the position or frame of reference of the disclosed embodiment.

Shield member 105 fully encloses housing 32 except for openings aligned with ports 33 and the bottom or lower surface of the housing. Shield member 105 includes tails 106 that are configured to extend into plated through-holes 102 in the circuit board 100 when mounted thereon. Tails 106 may include compliant press-fit members 107 in order to make an electrical connection to the plated through-holes 102 without soldering.

Housing 32 includes ports 33 positioned in two horizontal rows in front housing section 34 that define a plurality of vertically aligned upper and lower ports 33. A rear section 35 of housing 32 is configured as a sub-assembly receiving recess or section in which multi-port sub-assembly 40 is positioned. Rear section 35 includes a series of vertical walls 36 that are positioned between and behind the upper row of ports 33 and extend from the front section 34 to the rear edge 32*a* of the housing. Each of the vertical walls 36 extends from a top wall AA of the housing 32 so as to provide a structural support in a vertical direction and includes a slot 37 extending along its bottom surface (top surface as viewed in FIGS. 2 and 4) in a direction generally parallel to the mating direction "A" to guide and secure multi-port sub-assembly 40 during assembly. If desired, the slot 37 may be configured with an undercut structure 38 (FIG. 2) so that, after assembly, the multi-port sub-assembly 40 will be vertically retained on the housing 32 by the interaction between the slots 37 and the complementary locking flange 59 on the multi-port sub-assembly 40. It should be noted that the complementary locking flange is optional but the benefit it provides is a more secure engagement between the vertical walls 36 and the multi-port sub-assembly 40.

Figure 2:
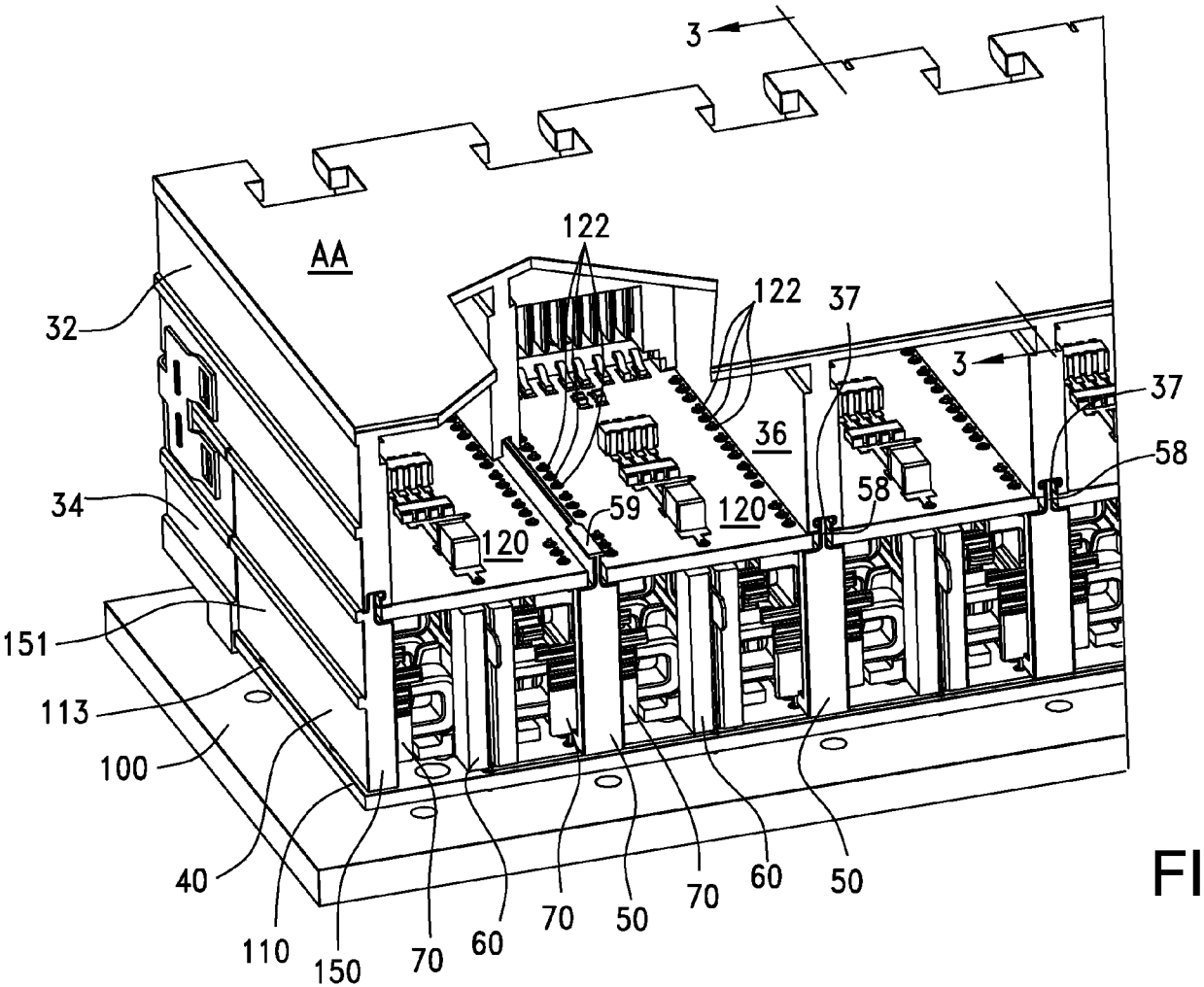
FIG. 2 is an enlarged, fragmented rear perspective view of the magnetic jack of FIG. 1 with the shield member removed.
Figure 3:
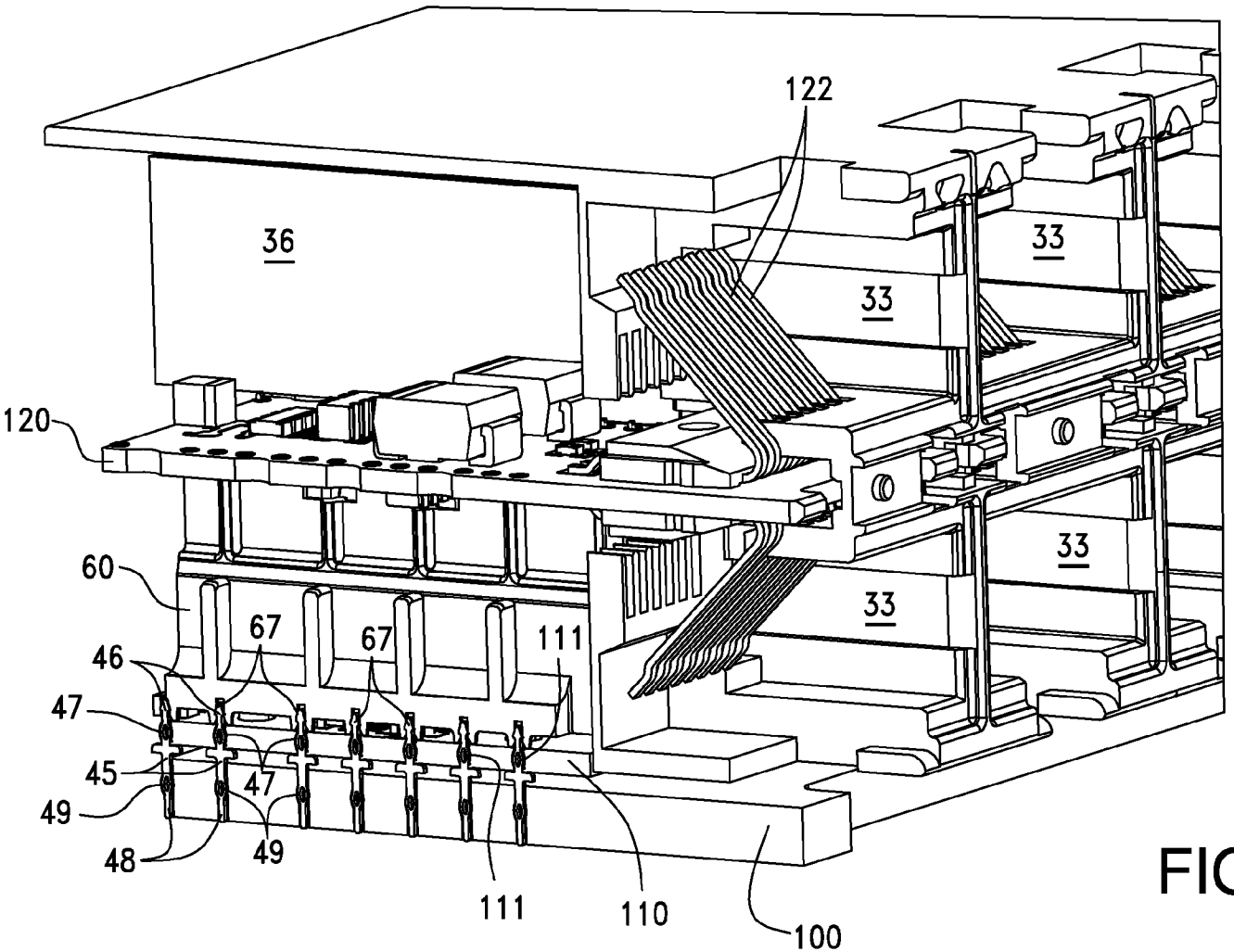
FIG. 3 is a perspective view taken generally along 3-3 of FIG. 2.

Referring to FIGS. 2-3, multi-port sub-assembly 40 includes a mounting circuit board 110 upon which a plurality of carrier assemblies 50 are positioned in an array. As depicted, the mounting circuit board extends under all the carriers (e.g., is a single mounting circuit board) but in alternative embodiments could be split into multiple circuit boards. Preferably the mounting circuit board would extend under at least two columns of ports so as to help provide additional support. A center wall 60 is positioned between each pair of carrier assemblies 50 and aligned within the ports 33 with housing 32 and a contact circuit board 120 is mounted to pairs of carrier and above each center wall.

Referring to FIGS. 6-10, each carrier assembly 50 includes a carrier 52 that is insulative and has an array of filtering assemblies 70 mounted on each side of the carrier 52. As depicted, the carrier 52 includes oppositely facing walls 53 onto which a linear array of filtering assemblies 70 is secured. The walls 53 include a series of filtering assembly receiving recesses 54 defined by upper and lower ledges 55 and vertical ribs or walls 56 that separate each of the recesses 54. Upper and lower ledges 55 each have a series of crush ribs 57 that are configured to deform upon the insertion of the filtering assemblies 70 into the recesses 54 in order to retain the filtering assemblies in place. The vertical walls 56 provide electrical isolation between the conductive components of adjacent filtering assemblies 70. A rail 58 extends lengthwise along the upper surface of each carrier 52 and is configured to be received within one of the slots 37 of the vertical walls 36 of the rear section 35 of housing 32. Rail 58 may have a locking flange (such as the depicted T-shaped cross-section) 59 along its entire length or at one end to retain the multi-port sub-assembly 40 on the housing 32 after assembly. More specifically, slot 37 of housing 32 can be configured to have a shape that is complementary to that of rail 58 and locking flange 59 so that housing 32 and sub-assembly 40 are vertically secured together upon assembly.

End carrier assemblies 150 adjacent the two sides 113 of mounting circuit board 110 each have only a single-sided carrier 152. Single-sided carrier 152 is substantially identical to double-sided carrier 52 except that it is configured to have filtering assemblies 70 mounted on only one side thereof. Single-sided carrier 152 includes only one wall 53 that is identical to one of the walls 53 of carrier 52 and includes a rail 58 that is also generally identically configured to that of carrier 52. The side 151 of single-sided carrier 152 opposite filtering assembly receiving wall 53 is generally planar and is not configured to receive filtering assemblies thereon. Referring to FIG. 3, it can be seen that the two end carrier assemblies 150 and their single-sided carriers 152 are configured to be the "mirror-image" of each other so that side 151 of each single-sided carrier defines the outer edges of multi-port sub-assembly 40.

As depicted, the carriers 52 and single-sided carriers 152 each include four filtering assemblies 70 and one additional filtering assembly 180 on each wall 53 so that the board engaging sections 85 of the first terminal array 81 and the second terminal array 82 form linear arrays of compliant or press-fit tails along the respective upper and lower surfaces of the carrier assemblies 50 and end carrier assemblies 150. Thus, the first and second terminal array 81, 82 have board engaging sections 85 that extend in different directions. While the depicted directions are depicted as directly opposite directions, in alternative embodiments the two directions are not so limited.

Center wall 60 is formed of an insulative material and is generally elongated and has a body 61 with an inverted, generally T-shaped cross-section and a post 62 at one end thereof. An upper portion of the body 61 has a series of spaced apart ribs or projections 63. The lower portion of the body 61 includes a plurality of angled projections 64 that extend laterally from body 61 and are aligned with ribs 63. Angled projections 64 are narrower towards the top of body 61 and wider at the point in which they engage the base 65 of the body. The ribs 63 and angled projections 64 form dividers to generally separate the upper and lower filtering sub-assemblies 90, 91 of a filtering assembly 70 from the upper and lower filtering sub-assemblies 90, 91 of adjacent filtering assemblies 70.

If desired, center wall 60 may have one or more conductive members extending vertically therein to electrically connect two circuit boards. As depicted, post 62 has a slot 66 in which a conductive member 185 is secured. Conductive member 185 has board engaging sections in the form of press-fit tails or complaint pins 186 extending from the top and bottom surfaces thereof to electrically connect mounting circuit board 110 to the contact circuit board 120. In addition, conductive member 185 also includes a tab 187 that fits within a slot 108 in the rear face 109 of the conductive shield member 105 of the jack 30. Once the shield member 105 has been closed around the housing 32 and multi-port sub-assembly 40, tab 187 is bent or deformed to secure the shield member in place and form an electrical connection between the mounting circuit board 110, the shield member 105 and the contact circuit board 120.

Contact circuit board 120 can be formed as a multi-layer circuit board and functions to electrically connect the signal terminals 81*a*, 81*b* of each upper terminal array 81 to a contact 121 mounted on the contact circuit board 120. Contact circuit board 120 has a plurality of plated through-holes 122 positioned along the two lateral edges 123 in order to define two linear arrays of through-holes. The spacing and size of the through-holes 122 correspond to the spacing and the size of the linear array of board engaging sections 85 on carrier assembly 50. Contact circuit board 120 includes an electrical connector 124 mounted on both the top and bottom surfaces thereof. Each connector 123 has a plurality of the contacts 121.

The circuitry (not shown) of the contact circuit board 120 is configured to electrically connect the contacts 121 of the upper surface of the circuit board to the signal terminals 81*a*, 81*b* of one of the linear arrays and electrically connect the contacts 121 attached to the lower surface of the circuit board to the signal terminals of the other linear array. Each port 33 includes eight contacts 121 that are electrically connected to each carrier assembly 50 and may be configured as four differential signal pairs. Each filtering assembly 70 provides a pair of signal paths 135, 136 between the mounting circuit board 110 and the contact circuit board 120. Each of the signal paths 135, 136 is electrically connected to one of the contacts 121 within a port 33 of the magnetic jack 30. Within each filtering assembly 70, the first signal path 135 is configured as one half (e.g., $S^+$) of a differential signal pair and the second signal path 136 is the second half (e.g., $S^-$) of the differential signal pair. The third terminal 81*c* of the first terminal array is configured as a centertap (CT). The linear arrays of board engaging sections 85 of upper terminal arrays 81 of the carrier assemblies 50 are configured as repeating patterns of differential signal pairs $S^+$, $S^-$ followed by a centertap CT. The circuitry of contact circuit board 120 is configured to electrically connect only the through-holes corresponding to each of the signal terminals 81*a*, 81*b* to the contacts 121.

Mounting circuit board 110 extends across the entire width of the multi-port sub-assembly 40 and functions as a base member of the sub-assembly. Each of the components of the multi-port sub-assembly 40 is mounted on, either directly or indirectly, the mounting circuit board 110. The mounting circuit board 110 has a plurality of plated through-holes 111 that are dimensioned and configured so as to receive the board engaging sections 85 of the lower terminal arrays 82 of the filtering assemblies 70 upon mounting the carrier assemblies 50 on the mounting circuit board.

As best seen in FIG. 3, some of the through-holes 111 of mounting circuit board 110 are aligned with receptacles 67 in the bottom of the center walls 60 so that contact tails 45 may be inserted from the bottom of mounting circuit board 110 and through the through-holes 111 and secured within the center walls 60. While this configuration is optional, as can be appreciated the configuration allows for the mounting circuit board 110 to have a standard footprint on a side that mates with a system circuit board while allowing adjustments on to the system on the other side of the mounting circuit board. The contact tails 45 can have a barb section 46 for creating an interference fit within receptacle 67 in the lower surface of center wall 60 in order to retain the tail to the jack 30. Tails 45 can further include a mounting board compliant section 47 that is deflectable so as to make an electrical connection with one of the plated through-holes 111 in the mounting circuit board 110 without the use of solder. An arm may extend from each side of the tail 45 in order to establish a seating depth for the insertion of tails 45 into multi-port sub-assembly 40. A tail portion 48 is provided for making an electrical connection to the system circuit board 100 and may be configured with a generally linear section configured to be soldered to the system circuit board or provided with a compliant or press-fit section 49 so that the jack 30 may be mounted on the system circuit board in a press-fit manner without requiring soldering.

Figure 9:
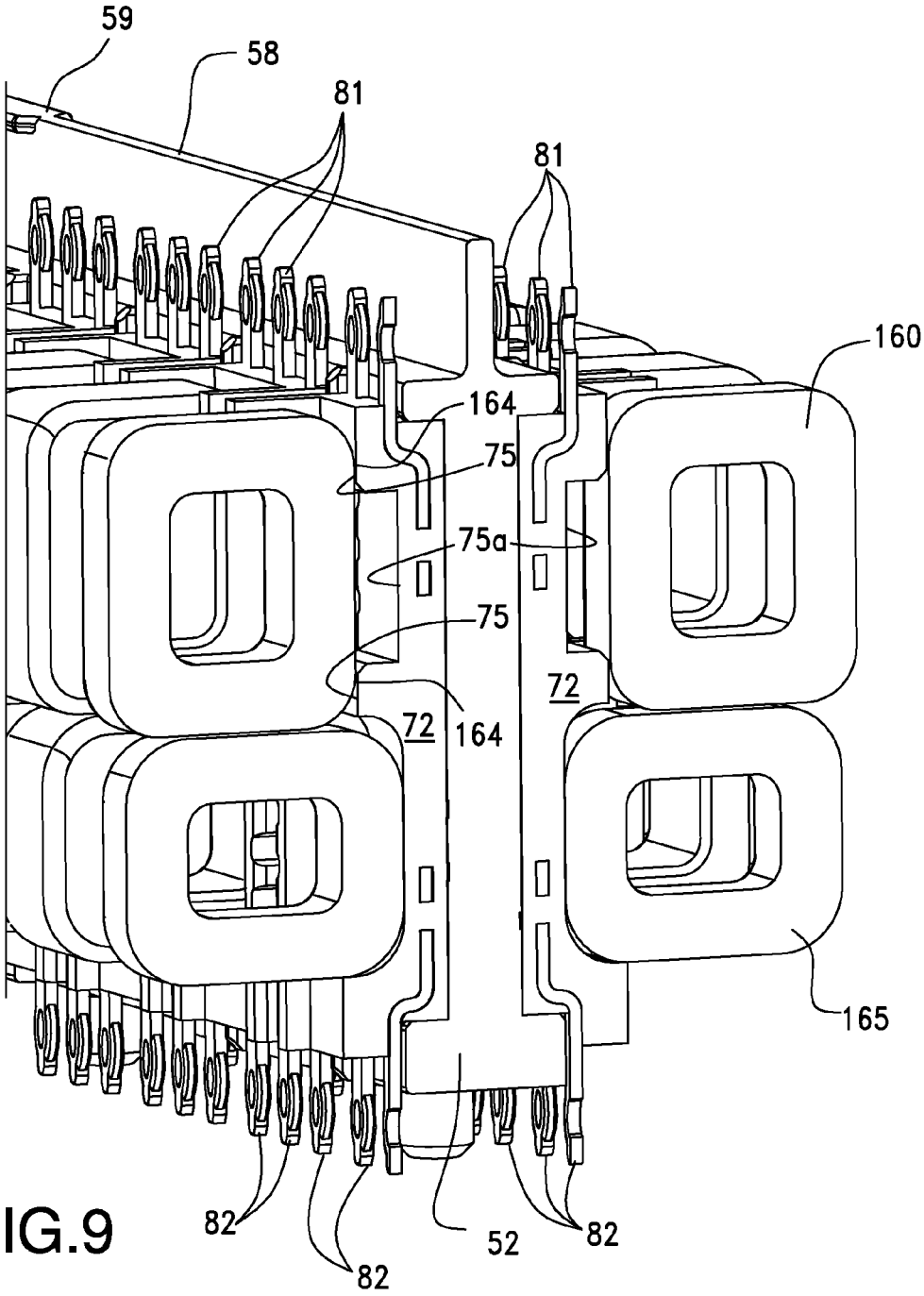
FIG. 9 is a perspective view of a section taken generally along line 9-9 of FIG. 6.
Figure 10:
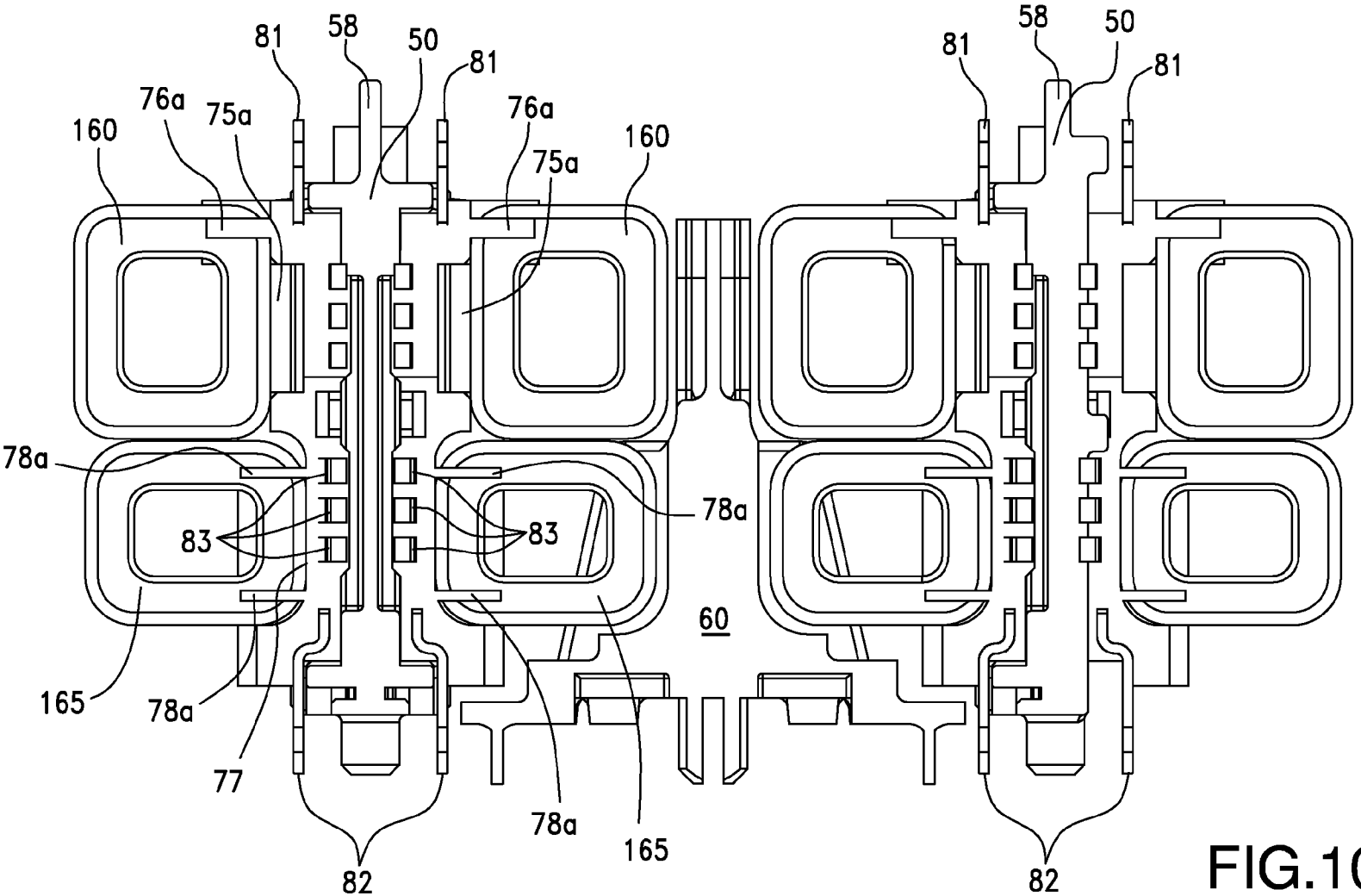
FIG. 10 is a sectional view of a pair of carrier assemblies together with a center wall positioned therebetween.
Figure 15:
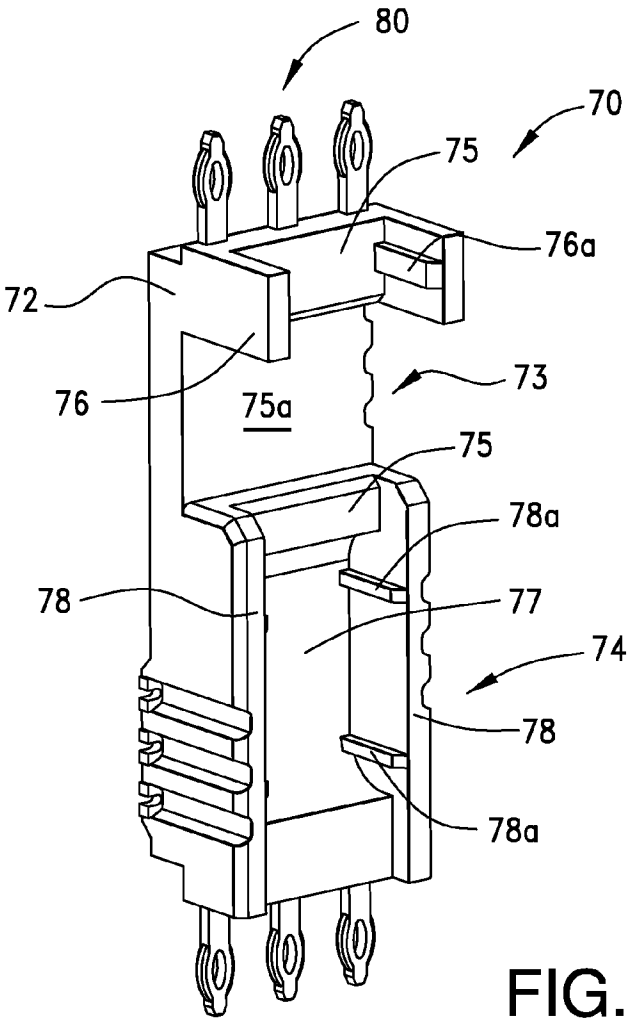
FIG. 15 is a front perspective view of the filtering assembly of FIG. 14.
Figure 14:
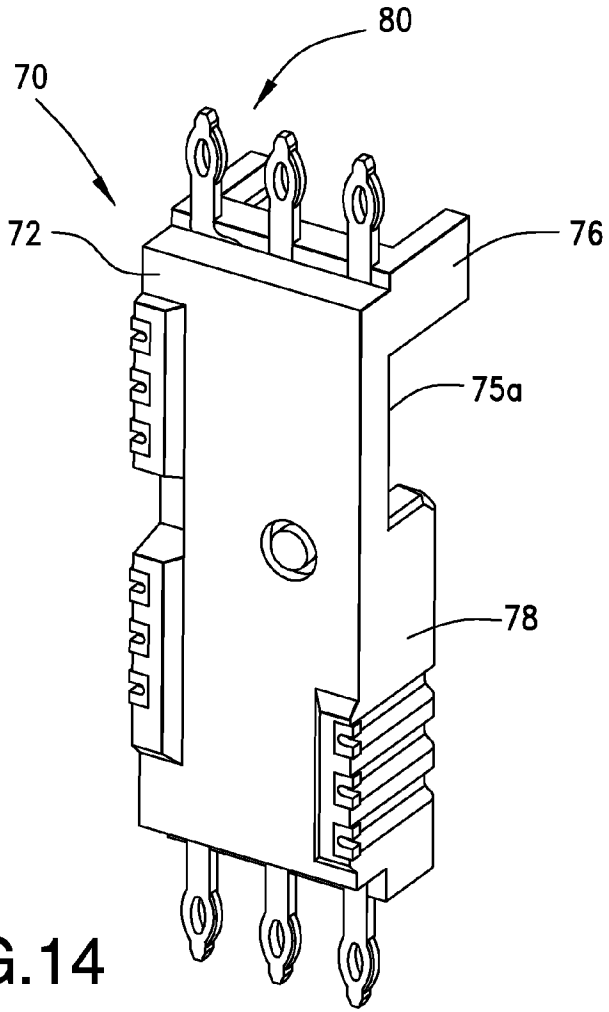
FIG. 14 is a rear perspective view of an embodiment of a filtering assembly with the upper and lower filtering sub-assemblies removed.

Referring to FIGS. 14-15, each filtering assembly 70 includes an insulative block or housing 72 having a plurality of electrically conductive terminals 80 and a pair of filtering sub-assemblies 90, 91 mounted thereon. Housing 72 is generally elongated in a vertical direction and includes an upper sub-assembly receiving section 73 in which an upper filtering sub-assembly 90 is positioned and a lower sub-assembly receiving section 74 in which a lower filtering sub-assembly 91 is positioned. As best seen in FIG. 9, upper filtering assembly receiving section 73 has a sub-assembly abutting face 75 against which a flat abutting surface 164 of the transformer core 160 of the upper filtering sub-assembly 90 is positioned. A recess 75*a* is provided in the abutting face in order to provide clearance for conductors or wires wound around the core of the upper filtering sub-assembly. A pair of projecting arms 76 extend away from abutting face 75 and include crush ribs 76*a* that are deformed against sidewalls 162 of the core 160 of upper filtering sub-assembly 90 in order to secure the upper filtering sub-assembly within the upper receiving section 73.

The lower sub-assembly receiving section 74 has a generally planar lower sub-assembly abutting face 77 and the lower filtering sub-assembly 91 has a flat abutting surface 164 of the choke core 165 that is positioned against the abutting face 77. A pair of vertically extending sidewalls 78 extend away from abutting face 77 and each includes a pair of spaced apart crush ribs 78*a* that can engage and be deformed by the sidewalls 162 of the core 165 of the lower filtering sub-assembly 91 upon insertion of the lower filtering sub-assembly 91 into the lower sub-assembly receiving section 74.

Figure 16:
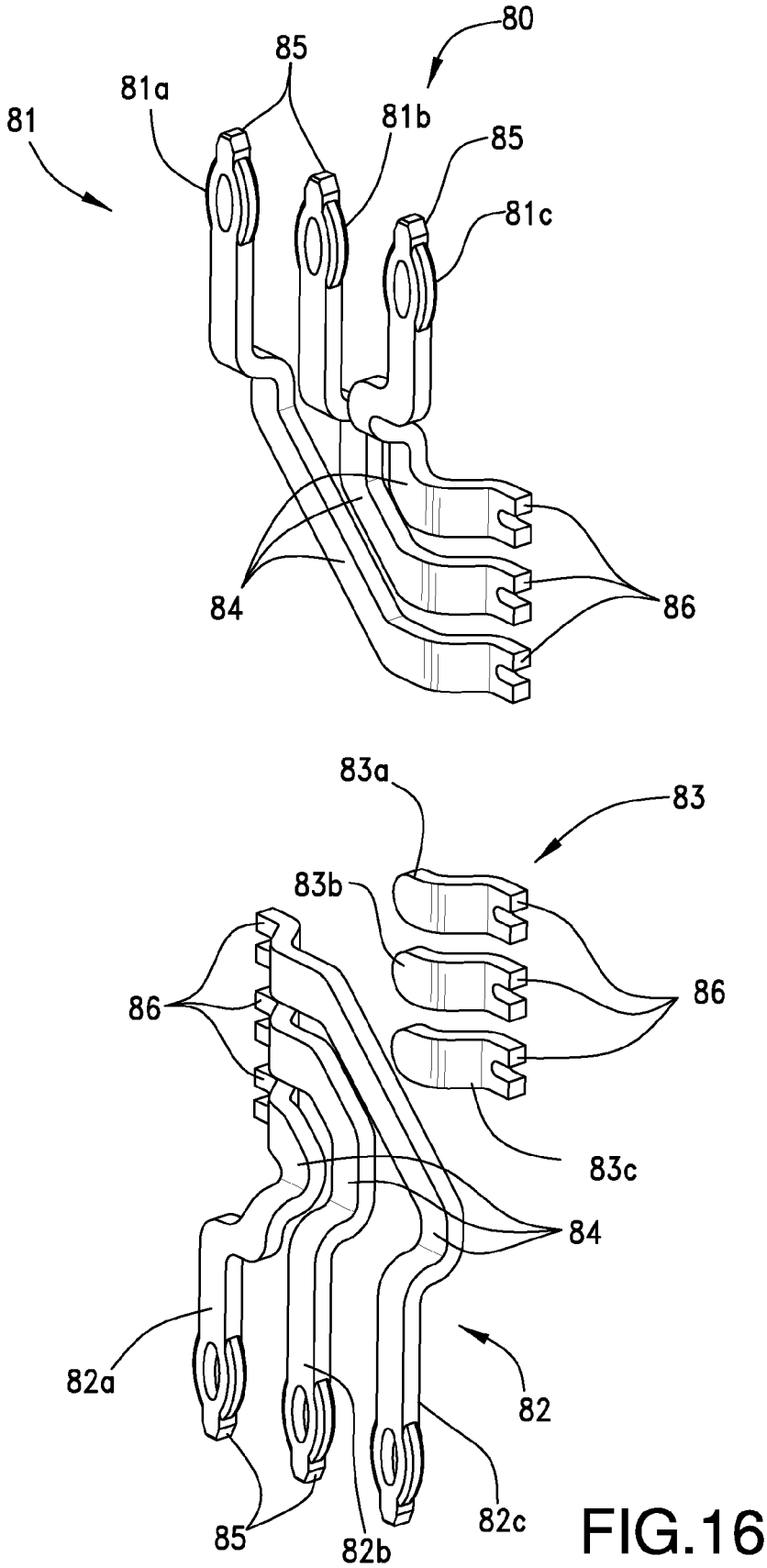
FIG. 16 is a perspective view of the terminals within the housing of FIG. 15.
Figure 17:
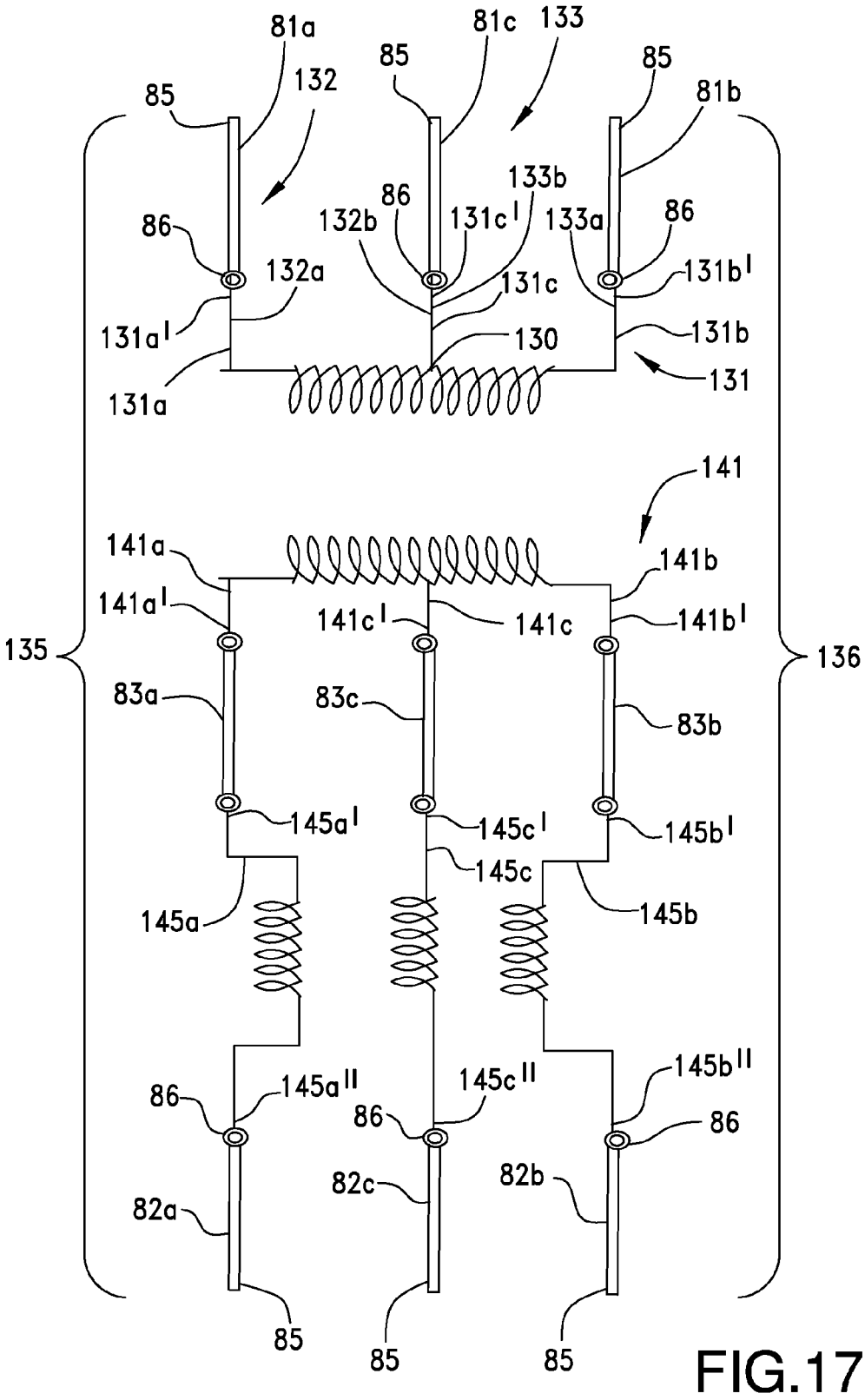
FIG. 17 is a schematic diagram of an embodiment of a filtering assembly.
Figure 20:
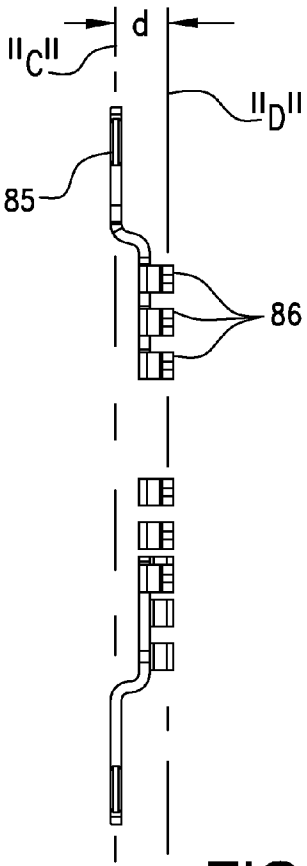
FIG. 20 is a side view of the terminals of FIG. 19.
Figure 19:
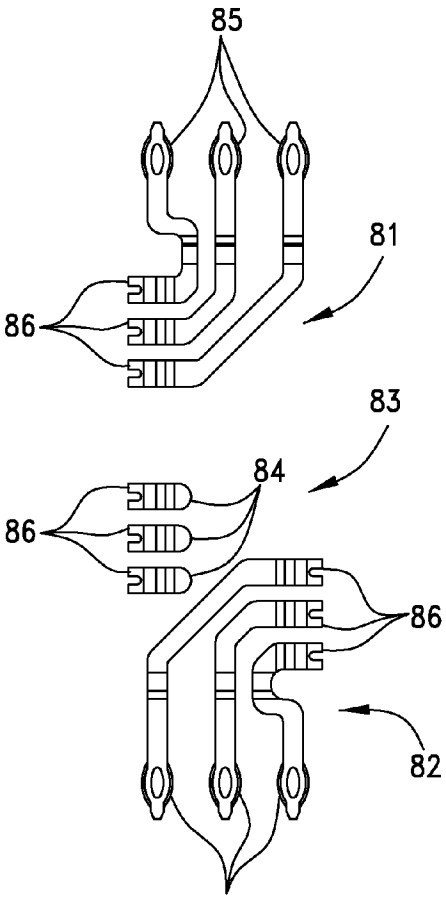
FIG. 19 is a rear elevational view of the terminals within the housing of FIG. 18.
Figure 18:
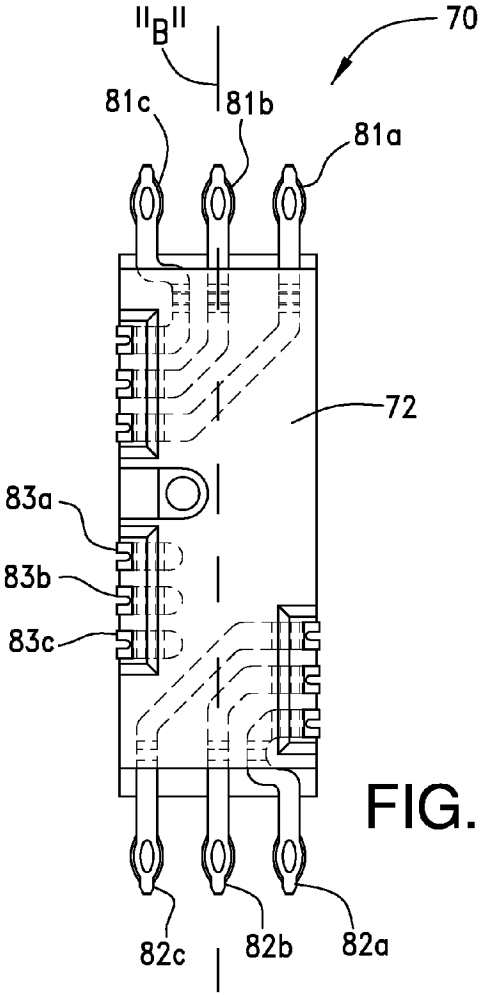
FIG. 18 is a rear elevational view of the filtering assembly of FIG. 14.

Referring to FIGS. 16, 19, 20, the electrically conductive terminals 80 within each housing 72 of filtering assembly 70 are depicted (and are represented schematically in FIG. 17). The terminals are configured so as to define a first or upper terminal array 81, a second or lower terminal array 82 and a third or intermediate terminal array 83. The body 84 of each terminal is embedded or insert-molded within housing 72 of filtering assembly 70 so that only the board engaging section 85 and the wire engaging section 86 are not enclosed or embedded within the housing 72. Upper terminal array 81 includes a first terminal 81*a*, a second terminal 81*b*, and a third terminal 81*c*. Each terminal has a board engaging section 85, which may be configured as a compliant pin for physically and electrically connecting to contact circuit board 120 and a wire or conductor engaging section 86 for physically and electrically connecting to a wire or conductor. Each terminal 81 has a body section 84 connecting its board engaging section 85 to its wire engaging section 86. As depicted, board engaging sections 85 extend upwardly from housing 72 in a direction generally parallel to axis "B" of housing 72. Wire engaging sections 86 extend from housing 72 in a direction generally perpendicular to the longitudinal axis "B" of housing 72 and thus the body section 84 of each terminal is configured to extend along the path between its board engaging section 85 and its wire engaging section 86. As such, the body section 84 of terminals 81*a* and 81*b* include a pair of sections that each bend at an angle of approximately 45 degrees and the third terminal 81*c* has a body section with three sections that each bend at an angle of approximately 90 degrees.

As depicted, lower terminal array 82 is substantially identical to the first terminal array 81 and includes a first terminal 82*a*, a second terminal 82*b* and a third terminal 82*c*. As with the upper terminal array 81, the board engaging sections 85 of the lower terminal array are all generally parallel to the longitudinal axis "B" of housing 72 but extend in a direction generally opposite the board engaging sections 85 of the upper terminal array. The wire engaging sections 86 of the lower terminal array extend in a direction generally perpendicular to longitudinal axis "B" but in a direction opposite the wire engaging sections 86 of the upper terminal array. Although the upper terminal array 81 and the second terminal array 82 are generally identically, some portions of the body sections 84 of the lower terminal array 82 may be bent or extend along a slightly different path as compared to the body sections 84 of the upper terminal array.

The intermediate terminal array 83 includes a first terminal 83*a*, a second terminal 83*b* and a third terminal 83*c*. Each of the terminals of the third terminal array 83 has a wire engaging section 86 and a body section 84 embedded within the housing 72. Only the wire engaging sections 86 of the third terminal array 83 extend out of housing 72. Each of the wire engaging sections 86 of the third terminal array 83 extend in a direction generally perpendicular to the longitudinal axis "B" and in the same direction as the wire engaging sections 86 of the first terminal array 81.

It can be seen that each of the board engaging sections 85 of the first terminal array 81 and the second terminal array 82 are generally positioned in a common plane "C." Each of the wire engaging sections 86 of the first terminal array 81, the second terminal array 82, and the third terminal array 83 are in a common plane "D." The plane "C" of the board engaging sections 85 is spaced from the plane "D" of the wire engaging sections 86 by a distance "d" so as to provide clearance for automated soldering of the wire engaging sections without contaminating the board engaging sections. In some applications, it has been found that setting the distance "d" to be approximately 1.0 mm is sufficient. In other applications, the distance "d" may be as small as approximately 0.5 mm or greater than 1.0 mm.

Figure 21:
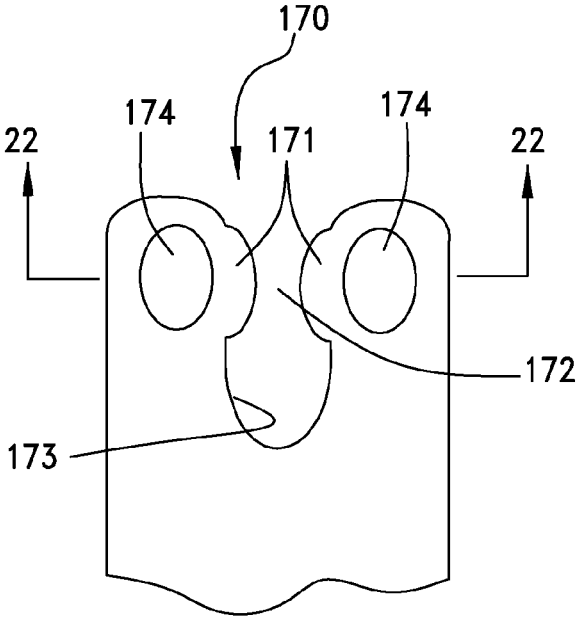
FIG. 21 is an enlarged view of a slot for retaining a conductor therein.
Figure 22:
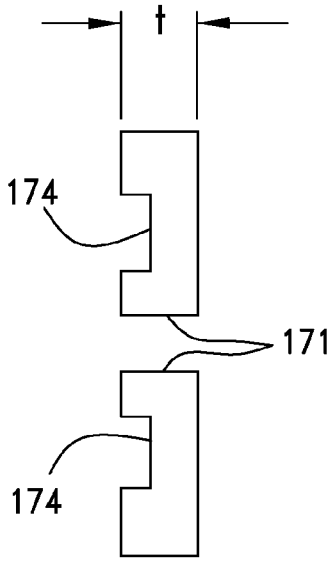
FIG. 22 is section taken generally along line 22-22 of FIG. 21.

In the figures depicting the filtering modules 70, the wire retention sections 86 are depicted in a simplified manner as slots. Referring to FIGS. 21-22, a slot 170 is depicted in more detail to show the structure utilized to secure the conductors or wires within the slot prior to soldering. Slot 170 includes a pair of arcuate projections 171 that create a narrowed neck or space 172 through which the conductors are forced as they move towards a retention space or reservoir 173. It should be noted that by forming the projections in an arcuate manner, the likelihood of cutting or breaking the conductors during insertion, handling and the subsequent soldering process is reduced. Since the retention slot of the terminals of the third terminal array 83 each receive a pair of conductors therein, the retention space or reservoir 173 of those terminals may be deeper or longer in an insertion direction to provide additional space to receive and secure the extra conductors.

The arcuate projections 171 may be formed by stamping, embossing or otherwise forming areas 174 of reduced thickness spaced from the edge of the slot 174 in order to displace the sheet metal material laterally into the slot 170. By creating the areas 174 of reduced thickness at a distance spaced from the edge of the slot, the thickness "t" along the arcuate projections 171 is maintained so as to be generally equal to the thickness of the sheet metal material from which the wire retention section 86 is formed. By avoiding a relatively thin surface engaging the conductors, the likelihood of cutting or breaking the conductors during the process of insertion, handling and soldering is reduced. Other configurations may be used to retain the conductors at the wire retention section 86 including slots having other shapes, a slot having a single projection 171 rather than the dual projections depicted in FIGS. 21-22, and other structures as would be appreciated by one skilled in the art. In an alternate embodiment, the conductors could be wrapped or wound around the terminals at the wire retention section.

Each upper filtering sub-assembly 90 has a plurality of wires or conductors wound around the toroidal core 160 and is configured to function as a transformer. The conductors are not shown in the Figures depicting the filtering assemblies 70, the terminals 80 or the upper and lower filtering sub-assemblies 90, 91 but are shown in the schematic diagram of FIG. 17. Referring to FIGS. 16-17, first and second sets of conductors 131, 141 are wound around the generally rectangularly-shaped toroid 160 with at least some of the first set of conductors being magnetically coupled to at least some of the second set of conductors. The first set of conductors 131 includes first and second signal conductors 131*a*, 131*b* together with a centertap conductor 131*c* that are all electrically connected at 130. The second set of conductors 141 also has first and second signal conductors 141*a*, 141*b* and a centertap 141*c* that are all electrically connected at 140. The first signal conductor 131*a* of the first set of conductors 131 is magnetically coupled to the first signal conductor 141*a* of the second set of conductors 141 in order to transmit a signal along a first signal path 135 that includes the first conductor 131*a* of the first set of conductors 131 and the first conductor 141*a* of the second set of conductors 141. Similarly, the second conductor 131*b* of the first set of conductors and the second conductor of the second set of conductors 141*b* are magnetically coupled in order to transmit a signal along a second signal path 136 that includes the second conductor 131*b* of the first set of conductors and a second conductor 141*b* of the second set of conductors. As can be appreciated by a person of skill in the art, the actual pattern used to arrange the conductors can be varied depending on desired performance and manufacturing processes and need not be discussed in detail herein.

Each lower filtering sub-assembly 91 has a plurality of wires or conductors 145 wound around the toroidal core 165 and is configured to function as a choke. More specifically, the lower filtering sub-assembly 91 includes a generally square-shaped toroid with a plurality of conductors wound therearound. In the depicted embodiment, three conductors 145*a*, 145*b*, 145*c* are wound around the core, and when part of filtering assembly 70, each is electrically connected to one of the signal paths 135, 136 or the centertap 141*c* of the second set of conductors 141 of the upper filtering sub-assembly 90. As in the case of the upper filtering sub-assembly, the actual pattern used to wind the conductors may be varied as desired.

As configured, a first signal path 135 is formed from the board engaging section 85 of first terminal 81*a* of first terminal array 81 through the upper and lower filtering sub-assemblies 90, 91 and to the board engaging section 85 of the first terminal 82*a* of the second terminal array 82. A second signal path 136 is formed from the board engaging section 85 of second terminal 81*b* of first terminal array 81 through the upper and lower filtering sub-assemblies 90, 91 and to the board engaging section 85 of the second terminal 82*b* of the second terminal array 82. More specifically, the first signal path 135 extends from the first terminal 81*a*, through the first conductor 131*a* of the first set of conductors 131 and is magnetically coupled to the first conductor 141*a* of the second set of conductors 141. The first conductor 141*a* of the second set of conductors is electrically connected to the first terminal 83*a* of the third terminal array 83 and then electrically connected to the first terminal 82*a* of the second terminal array 82 by the first conductor 145*a* of the set of conductors 145 of the lower filtering sub-assembly 91.

The second signal path 136 through the filtering assembly 70 extends from the board engaging section 85 of the second terminal 81*b* of the first terminal array 81 and through the second conductor 131*b* of the first set of conductors 131 that is wound around the core 160 of the upper filter sub-assembly 90. The second conductor 131*b* of the first set of conductors is magnetically coupled to the second conductor 141*b* of the second set of conductors 141 which is electrically connected to the second terminal 83*b* of the third terminal array 83. The second terminal 83*b* of the third terminal array 83 is electrically connected to the second terminal 82*b* of the second terminal array 82 by the second conductor 145*b* of the set of conductors 145 of the lower filtering sub-assembly 90. The centertap conductor 141*c* of the second set of conductors 141 is electrically connected to the third terminal 83*c* of the third terminal array 83 and electrically connected to the third terminal 82*c* of the second terminal array 82 by the third conductor 145*c* of the set of conductors 145 of the lower filtering sub-assembly 91. In summary, filtering assembly 70 has three arrays of terminals 81, 82, 83 together with three sets of conductors 131, 141, 145 with the first two sets of conductors 131, 141 wound around the core 160 of the upper filtering sub-assembly 90 and the third set of conductors 145 wound around the core 165 of the lower filtering sub-assembly 91. The two sets of conductors 131, 141 of the upper filtering sub-assembly are configured so as to magnetically couple the conductors and third set of conductors 145 is electrically connected to the second set of conductors 141 through the terminals of the third terminal array 83.

As can be appreciated, the second and third set of conductors could be combined to form a single set of conductors as each individual conductors in the second is electrically connected to a corresponding conductor in the third set. Thus, in certain embodiments the filtering assembly 70 could have just two sets of conductors that are coupled at the center tap but allows the primary and secondary windings to magnetically couple together. More preferably, however, a break in the conductor will occur between the transformer and the choke so as to allow the transformer and the choke to be wound separately and joined together in the filtering assembly as disclosed herein as discussed below.

If desired, an additional filtering assembly 180 may be provided along wall 53 that serves to provide a filtering function for power-over-Ethernet ("POE") circuitry. The housing 72 and terminal configuration of the additional filtering assembly 180 may be identical to that of filtering assemblies 70 in order to reduce the number of parts necessary for the manufacture of jack 30. In the additional filtering assembly 180, only the conductors of the lower filtering sub-assembly 91 are used and the upper filtering sub-assembly 90 omitted. One end of a first conductor 145 of the lower filtering sub-assembly 91 is connected to the wire engaging section 86 of the first terminal 81*a* of the first terminal array 81 and the opposite end is connected to the wire engaging section 86 of the first terminal 82*a* of the second terminal array 82. One end of a second conductor 145*b* of the lower filtering sub-assembly 91 is connected to the wire engaging section 86 of the second terminal 81*a* of the first terminal array and the opposite end is connected to the wire engaging section 86 of the second terminal 82*a* of the second terminal array. Finally, one end of a third conductor 145*c* of the lower filtering sub-assembly 91 is connected to the wire engaging section 86 of the third terminal 81*c* of the first terminal array and the opposite end is connected to the wire engaging section 86 of the third terminal 82*c* of the second terminal array. With such a configuration, the third terminal array 83 is not used.

Figure 23:
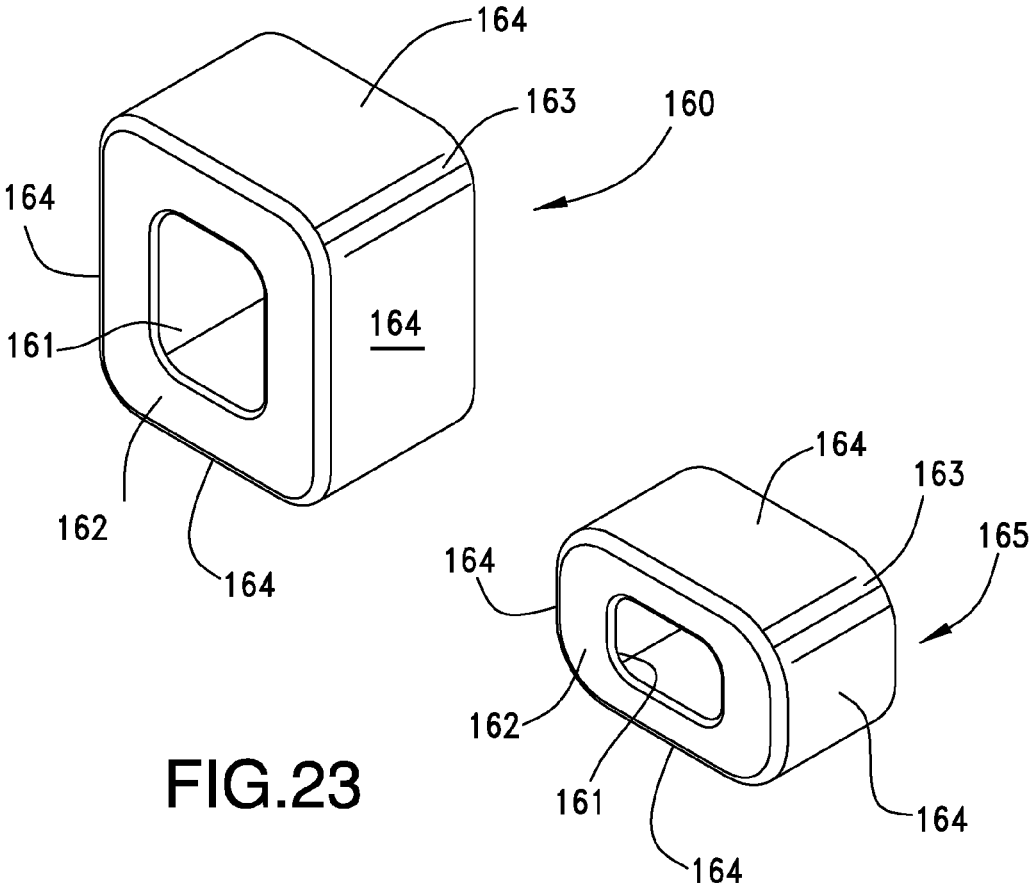
FIG. 23 is a perspective view of the rectangular and square toroids of a filtering assembly.

It should be noted that each of the cores 160, 165 (FIG. 23) around which the conductors are wound are configured as generally rectangular or square toroids. Both the rectangular toroid 160 and the square toroid 165 include a generally rectangular inner passage 161 that extends between generally planar oppositely facing sidewalls or outer surfaces 162 and a continuous outer circumferential surface 163 that has four flat sides or surfaces 164. By utilizing a toroid having one or more flat outer surfaces 164 along the continuous circumferential outer surface 163, automated handling of the cores and the subsequently formed filtering sub-assemblies is simplified. Automated handling of these components can simplify automated manufacturing of aspects of the jack 30. In some applications, it has been found that replacing a circular-shaped toroid with a rectangular toroid does not significantly degrade the magnetic performance of the core. It should be noted that as used herein, toroid refers to a shape that can be circular, rectangular or some other shape that includes an aperture about which conductors may be wound. In some applications, cores having other shapes with one or more flat outer surfaces besides a generally rectangular or square toroid may also be used.

Board engaging sections 85 of the terminals 80 are configured as press-fit pins or tails so that the filtering assemblies 70 may make an electrical connection with a circuit board without the necessity of a soldering process. The press-fit tails of the board retention section 85 of the upper terminal array 81 is configured to be pressed into plated through-holes 122 within the contact circuit board 120 and the press-fit tails of the lower terminal array 82 are configured to be pressed into plated through-holes 111 of the mounting circuit board 110 so that the process of assembling multi-port sub-assembly 40 may be completed without soldering. In addition, tails 45 are press-fit into plated through-holes 111 of mounting circuit board 110. Tails 45 may also include a press-fit section 49 for mating with plated through holes 102 of system circuit board 100. Through such a configuration, the jack 30 may be assembled and, if desired, mounted on system circuit board 100 without soldering (other than forming the filtering sub-assemblies 90, 91). In other words, the process of assembling the various circuit boards together may be completed without requiring soldering.

Figure 11:
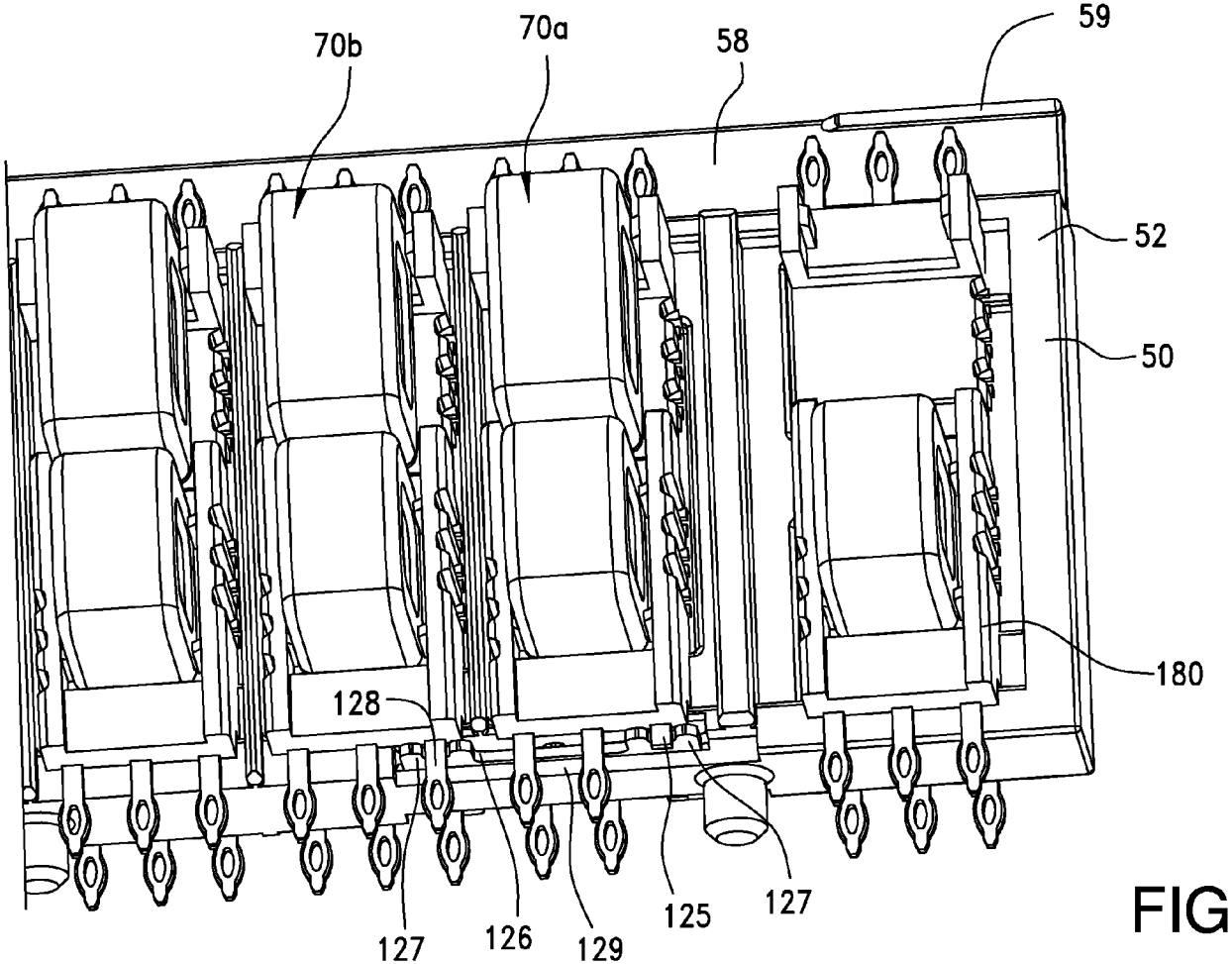
FIG. 11 is a perspective view of a carrier assembly taken generally from below the carrier assembly and showing a shorting bar between terminals of adjacent filtering assemblies.
Figure 12:
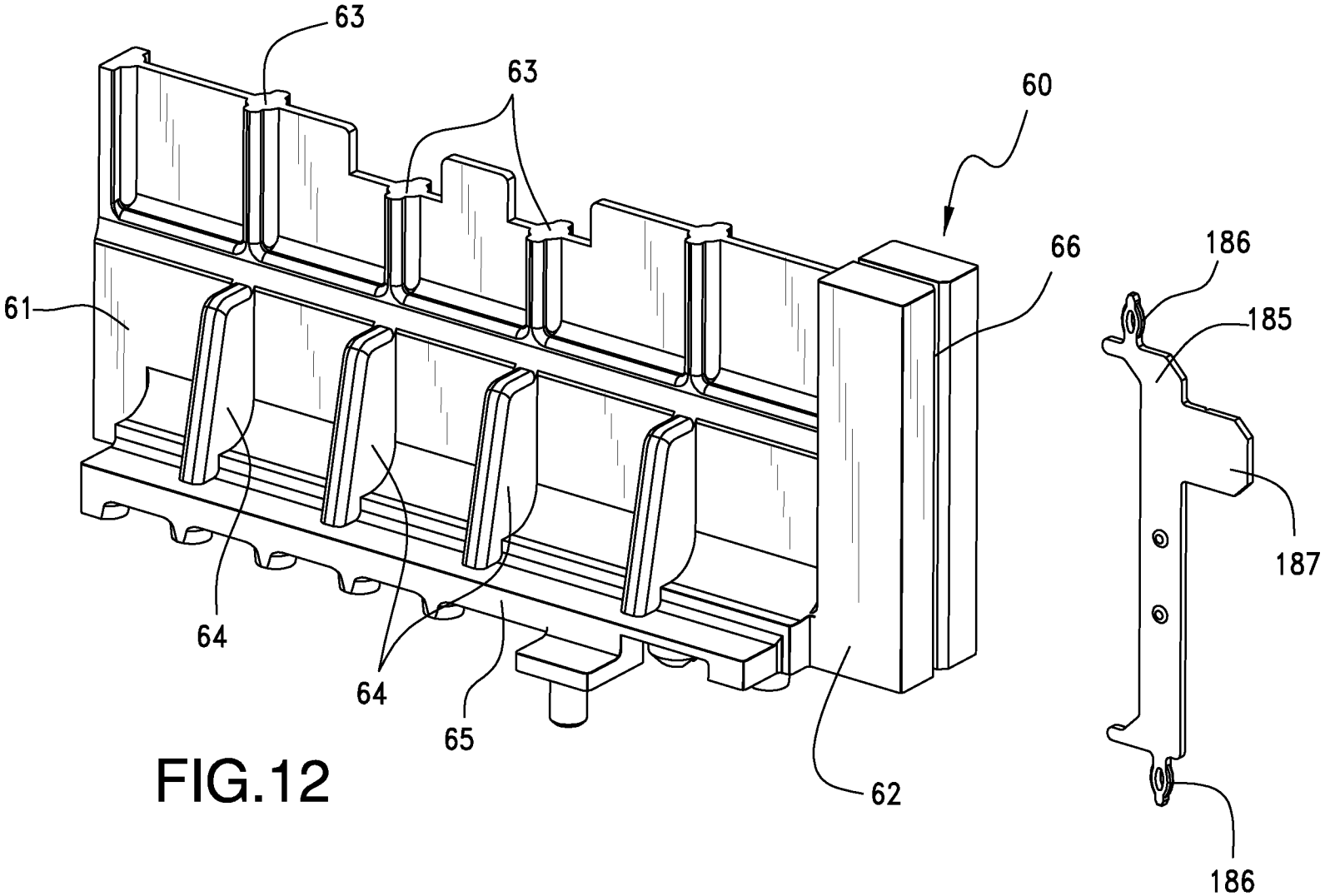
FIG. 12 is an exploded perspective view of a center wall together with a grounding bar.
Figure 13:
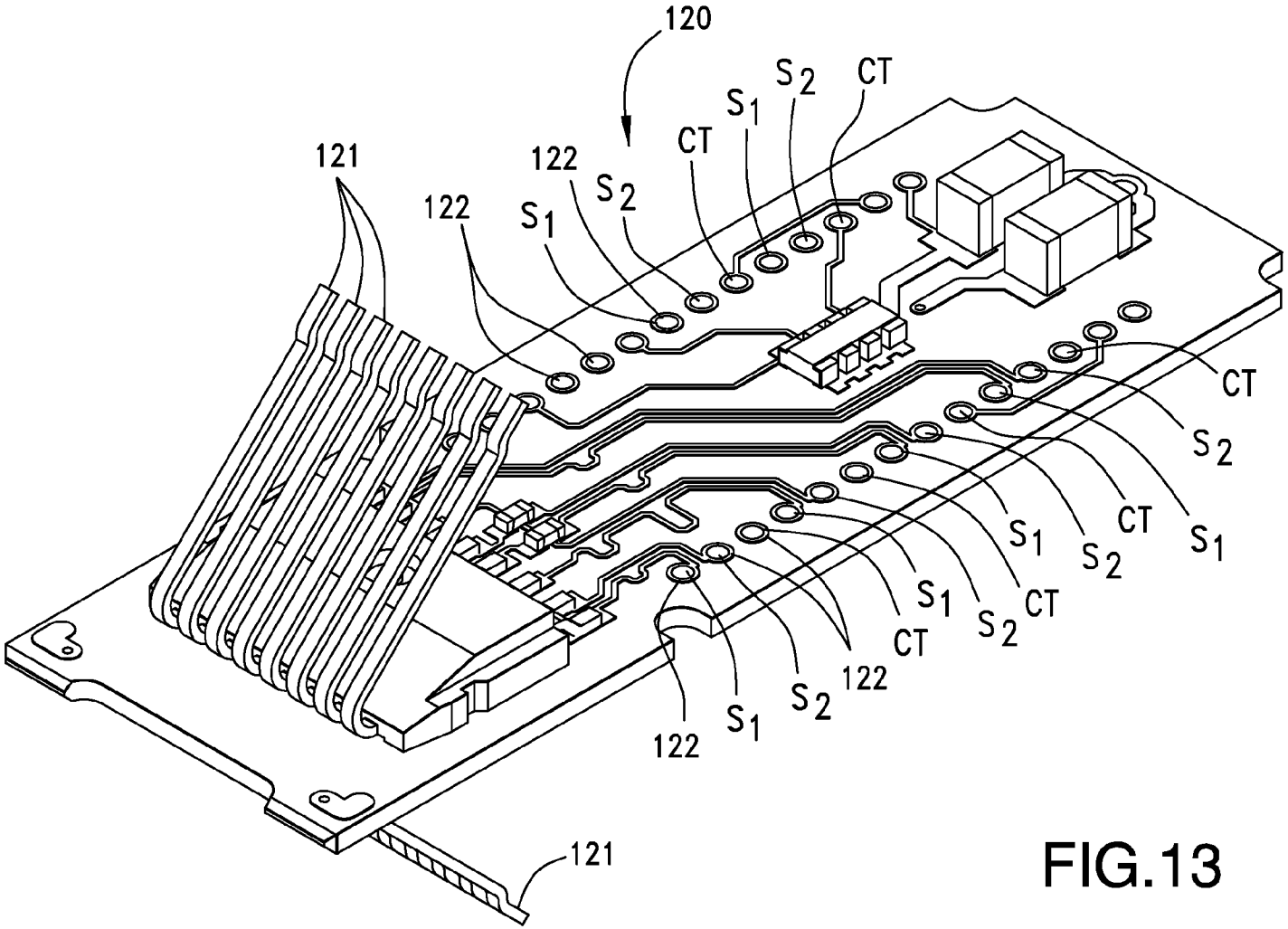
FIG. 13 is a perspective view of a contact circuit board.

In some circumstances, it is necessary to maintain predetermined clearance distances between electrical components. This can increase the complexity of routing circuitry or the placement of certain conductive components. If the position of a board mounting section 85 of a centertap terminal (e.g., the third terminal 82*c* of a lower terminal array 82) causes such a routing or placement challenge, it may be desirable to remove or cut-off the board engaging section and create an electrical connection with a centertap circuit of an adjacent filtering assembly 70. Referring to FIG. 11, a filtering assembly 70*a* is depicted with the third terminal 82*c* having its board engaging section removed and thus leaving a cut-off stub 125. A conductive shorting bar 126 has a pair of spaced-apart receptacles 127 configured to engage the cut-off stub 125 of a first filtering assembly 70*a* and the engaging section 128 above the board engaging section 85 of the third terminal 82*c* of the adjacent filtering assembly 70*b*. Carrier 52 has a slot 129 configured to receive the shorting bar 126 therein so that upon mounting the filtering assemblies 70 in the filtering assembly receiving recesses 54 of carrier 52, the cut-off stub 125 of the first filtering assembly 70*a* will slide into one receptacle 127 of shorting bar 126 and the engaging section 128 of the third terminal of the adjacent filtering assembly 70*b* will engage the other receptacle 127. Once the centertap terminals 125 are secured within the receptacles 127 of the shorting bar 126, solder may be applied in order to provide a secure and reliable electrical connection.

When assembling each filtering assembly 70, first and second sets of conductors 131, 141 are initially formed. In one configuration, the first set of conductors 131 may be formed with three conductive members or wires each having one end centrally connected (e.g., at 130) in order to define the first and second conductors 131*a*, 131*b* as well as the centertap 131*c*. The second set of conductors 141 may be formed in an identical manner. In an alternate embodiment, the set of conductors 131 may be formed with only two conductive members 132, 133 (FIG. 17), each of which has first and second sections. The first section 132*a* of the first conductive member acts as the first conductor 131*a* of the first set of conductors 131 and the first section 133*a* of the second conductive member acts as the second conductor 131*b* of the first set of conductors. The second section 132*b* of the first conductive member and the second section 133*b* of the second conductive member of the first set of conductors are electrically connected along their length in order to form the centertap conductor 131*c*. The second set of conductors 141 may be formed in a similar manner. If desired, each conductor may be a single wire or replaced by one or more smaller gauge wires that are electrically connected and provide sufficient current carrying and other functional capabilities. In some applications, individual 34 gauge wires have been used. In other applications, the 34 gauge wires have been replaced by a pair of 40 gauge wires.

After the sets of conductors 131, 141, 145 have been formed, the upper and lower filtering sub-assemblies 90, 91 are assembled by winding the first and second sets of conductors 131, 141 around rectangular transformer core 160 in order to magnetically couple the two sets of conductors. The third set of conductors is wound around the square choke core 165. While the process of winding the sets of conductors around the cores 160, 165 is intended to be performed in an automated manner, it may also be performed manually.

To assemble the filtering assemblies 70, each of the first set of conductors 131 of the upper filtering sub-assembly is secured to one the wire retention sections 86 of the upper terminal array 81. More specifically, the free end 131*a*' of the first conductor 131*a* of the first set of conductors 131 is secured to the wire retention section 86 of the first terminal 81*a* of the first terminal array 81, the free end 131*b*' of the second conductor 131*b* of the first set of conductors is secured to the wire retention section 86 of the second terminal 81*b* of the first terminal array, and the free end 131*c*' of the third or centertap conductor 131*c* of the first set of conductors is secured to the wire retention section 86 of the third terminal 81*c* of the first terminal array. The free end 141*a*' of the first conductor 141*a* of the second set of conductors 141 is secured to the wire retention section 86 of the first terminal 83*a* of the third terminal array 83, the free end 141*b*' of the second conductor 141*b* of the second set of conductors is secured to the wire retention section 86 of the third terminal 83*b* of the third terminal array, and the free end 141*c*' of the third or centertap conductor 141*c* of the second set of conductors is secured to the wire retention section 86 of the third terminal 83*c* of the third terminal array 83. Due to the magnetic coupling between the first set of conductors 131 and the second set of conductors 141 and the electrical connection between the first set of conductors 131 and the first terminal array 81 as well as the electrical connection between the second set of conductors 141 and the third terminal array 83, the first terminal 81*a* of the first terminal array is magnetically coupled to the first terminal 83*a* of the third terminal array and the second terminal 81*b* of the first terminal array is magnetically coupled to the second terminal 83*b* of the third terminal array.

A first end 145*a*' of the first conductor 145*a* that is wound around the square choke core 165 of the lower filtering sub-assembly 91 is secured to the wire retention section 86 of the first terminal 83*a* of the third terminal array 83 and the opposite end 145*a*" is secured to the wire retention section 86 of the first terminal 82*a* of the second terminal array 82. The first end 145*b*' of the second conductor 145*b* wound around the core 165 of the lower filtering sub-assembly 91 is secured to the wire retention section 86 of the second terminal 83*b* of the third terminal array 83 and the opposite end 145*b*" is secured to the wire retention section 86 of the second terminal 82*b* of the second terminal array 82. The first end 145*c*' of the third conductor 145 wound around the core 165 of the lower filtering sub-assembly 91 is secured to the wire retention section 86 of the third terminal 83*c* of the third terminal array 83 and the opposite end 145*c*" of the conductor is secured to the wire retention section 86 of the third terminal 82*c* of the second terminal array 82. As can be appreciated, the use of the third terminal array 83 permits the upper and lower filtering sub-assemblies 90, 91 to be formed as part of two distinct winding processes. The ability to have separate winding processes simplifies the manufacturing process and permits automated winding of the cores. In addition, each of the sub-assemblies may be separately tested after being formed which may reduce scrap.

After the conductors are secured to the wire retention sections 86, it is typically desirable to apply solder to the intersection between each conductor and terminal to create a reliable, permanent mechanical and electrical connection between the conductors and terminals. Referring to FIG. 20, it can be seen that each of the board engaging sections 85 of the terminals is positioned in a plane "C" with each of the wire retention sections 86 positioned in a plane "D" that is spaced from plane "C" by a distance "d." This configuration permits simultaneous soldering of the wire retention sections 86 by placing the rear face of the filtering assembly 70 into or along a solder bath or reservoir (not shown) a sufficient distance so that the exposed wire retention sections 86 are submerged within or engage the solder reservoir while maintaining the board engaging sections 85 above the surface of the solder reservoir. This configuration permits automated, simultaneous soldering of the conductors secured to the wire retention sections 85 without contaminating the board engaging sections 85. In one application, the distance "d" between the plane "C" of the board engaging sections 85 and the plane "D" of the wire retention sections 86 has been set at approximately 1.0 mm, although other distances may be used as desired provided that engagement or contamination of the board engaging sections is avoided.

Figure 7:
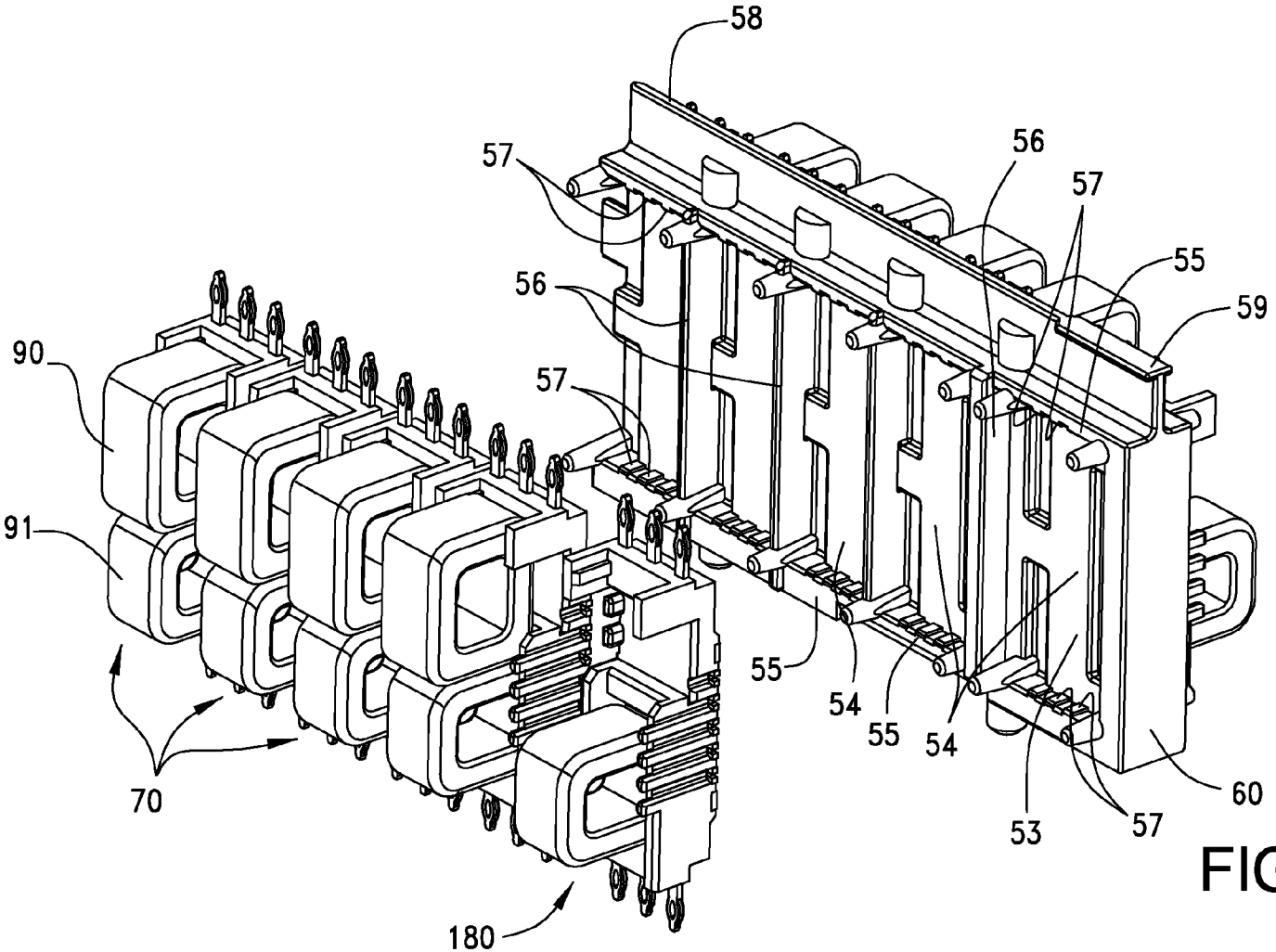
FIG. 7 is a perspective view similar to FIG. 6 but with the filtering assemblies of one side spaced from the carrier.
Figure 8:
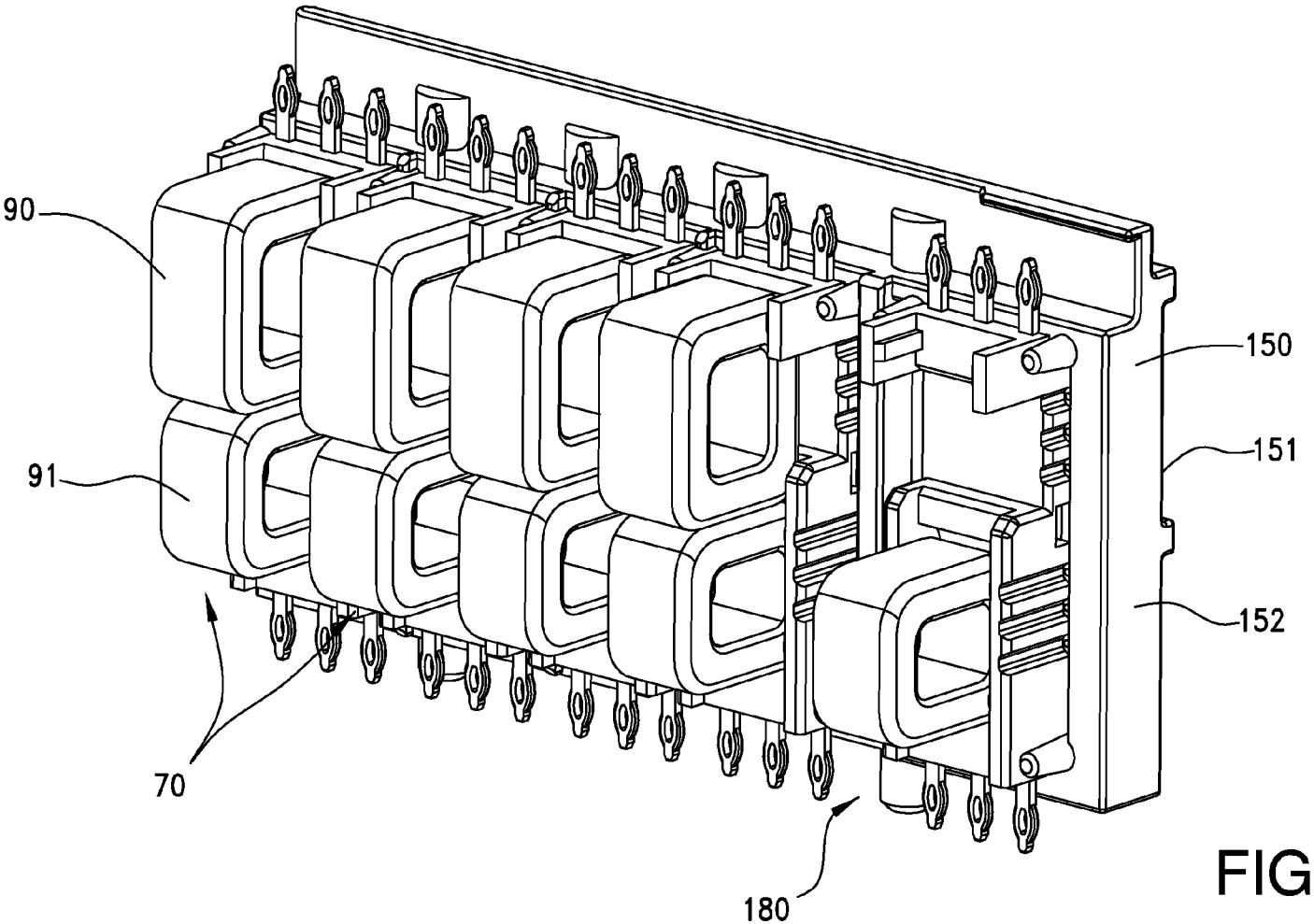
FIG. 8 is a perspective view of a single-sided carrier with filtering assemblies mounted thereon.

To assemble jack 30, each of the filtering assemblies 70 are assembled as described above. Individual filter assemblies 70 are aligned with the filtering assembly receiving recesses 54 on each wall 53 of the carriers 52 and pressed into the recesses. The top and bottom surfaces of the housing 72 engage crush ribs 57 positioned along the top and bottom ledges 55 of the carrier 52 as best seen in FIG. 7. A mounting circuit board 110 is provided and a plurality of center walls 60 are mounted on the mounting circuit board 110 in a generally spaced apart and parallel manner with the post 62 of each center wall positioned along the rear edge 112 of the mounting circuit board. A carrier assembly 50 is then aligned between each pair of center walls 60 so that the compliant tails of the board mounting sections 85 of the lower terminal array 82 of each filtering assembly 70 are aligned with through-holes 111 in the mounting circuit board 110. Each carrier assembly 50 is then moved relatively towards mounting circuit board 110 to establish an electrical connection between each of the terminals of the filtering assemblies 70 and the circuitry of the mounting circuit board 110. End carrier assemblies 150 having filtering assemblies 70 on only one side are mounted at respective ends or sides 113 of mounting circuit board 110 in a manner similar to the mounting of carrier assemblies 50. A contact circuit board 120 is then positioned generally between the guide rails 57 of each carrier assembly 50 and over each center wall 60. The plated through-holes 122 of each contact circuit board 120 are aligned with the board engaging sections 85 of the upper terminal arrays 81 and the contact circuit board 120 is moved relatively towards the mounting circuit board 110 so that the compliant pin of each board engaging section is compressed and slides into and makes an electrical connection with the through-holes of the contact circuit board 120. In addition, the compliant or press-fit pins 186 of each conductive member 185 electrically connect ground or reference circuits of the mounting circuit board 110 to those of the contact circuit board 120.

It should be noted that the contact circuit board 120 is electrically connected to the filtering assemblies 70 on a first wall 53 of a carrier 52 and to the filtering assemblies 70 on a facing wall 53 on an adjacent carrier. As a result, the linear arrays of filtering assemblies 70 on the oppositely facing walls 53 of a single carrier 52 are electrically connected to contacts 121 of adjacent contact circuit boards 120 and thus to the contacts 121 in adjacent pairs of aligned ports.

Figure 4:
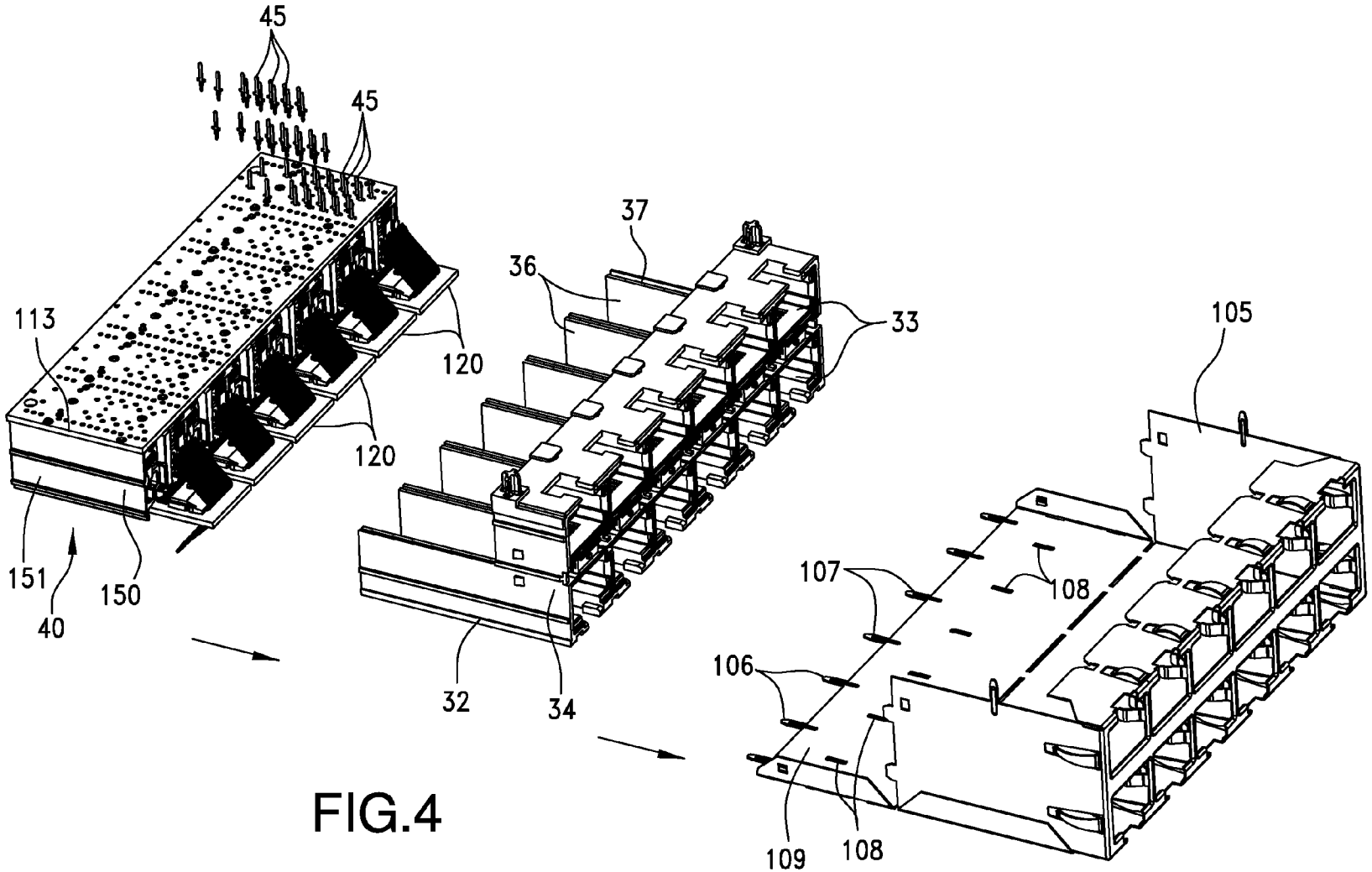
FIG. 4 is a partially exploded perspective view of the magnetic jack of FIG. 1 taken from a bottom perspective.
Figure 5:
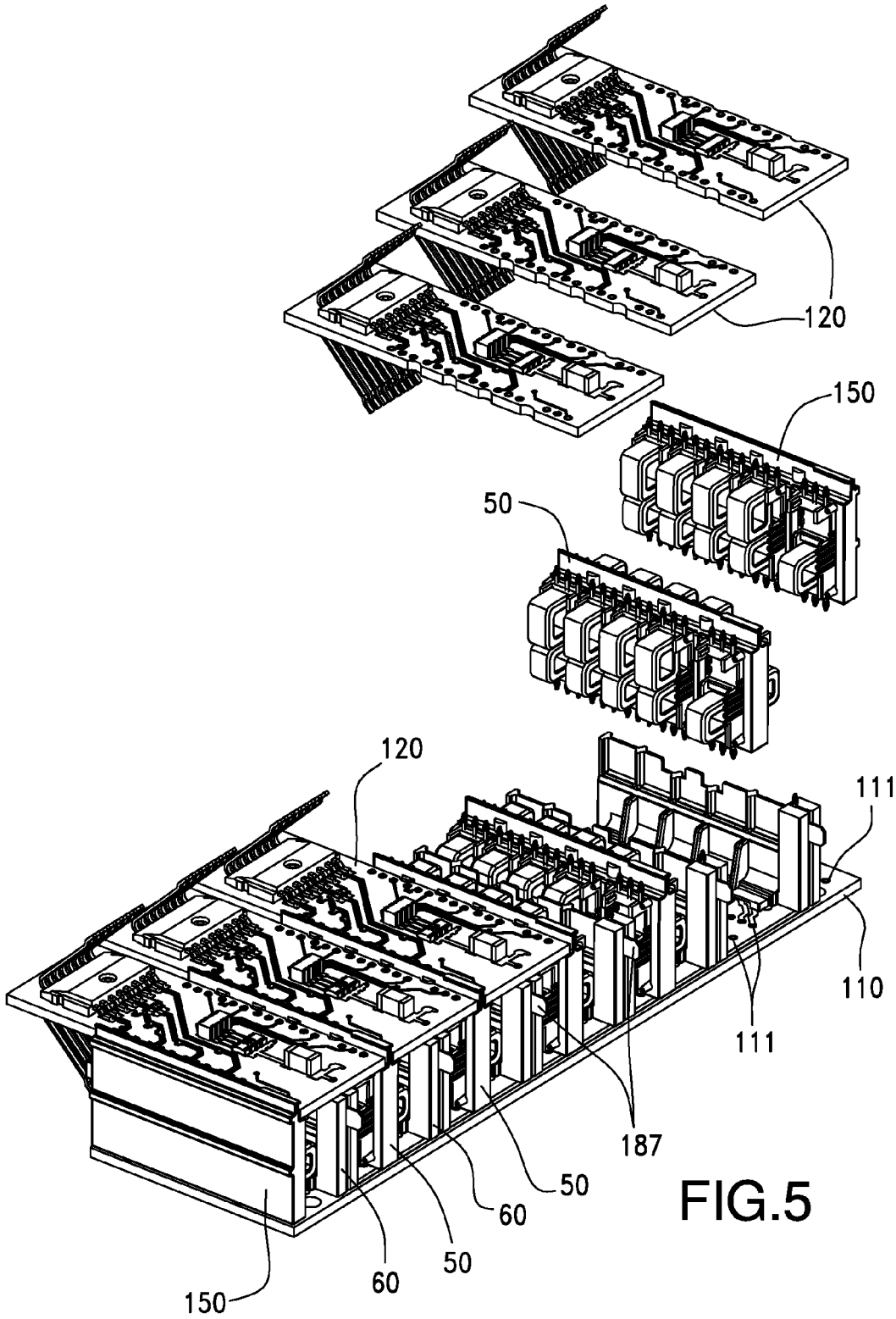
FIG. 5 is a partially exploded rear perspective view of the multi-port sub-assembly of FIG. 4.
Figure 6:
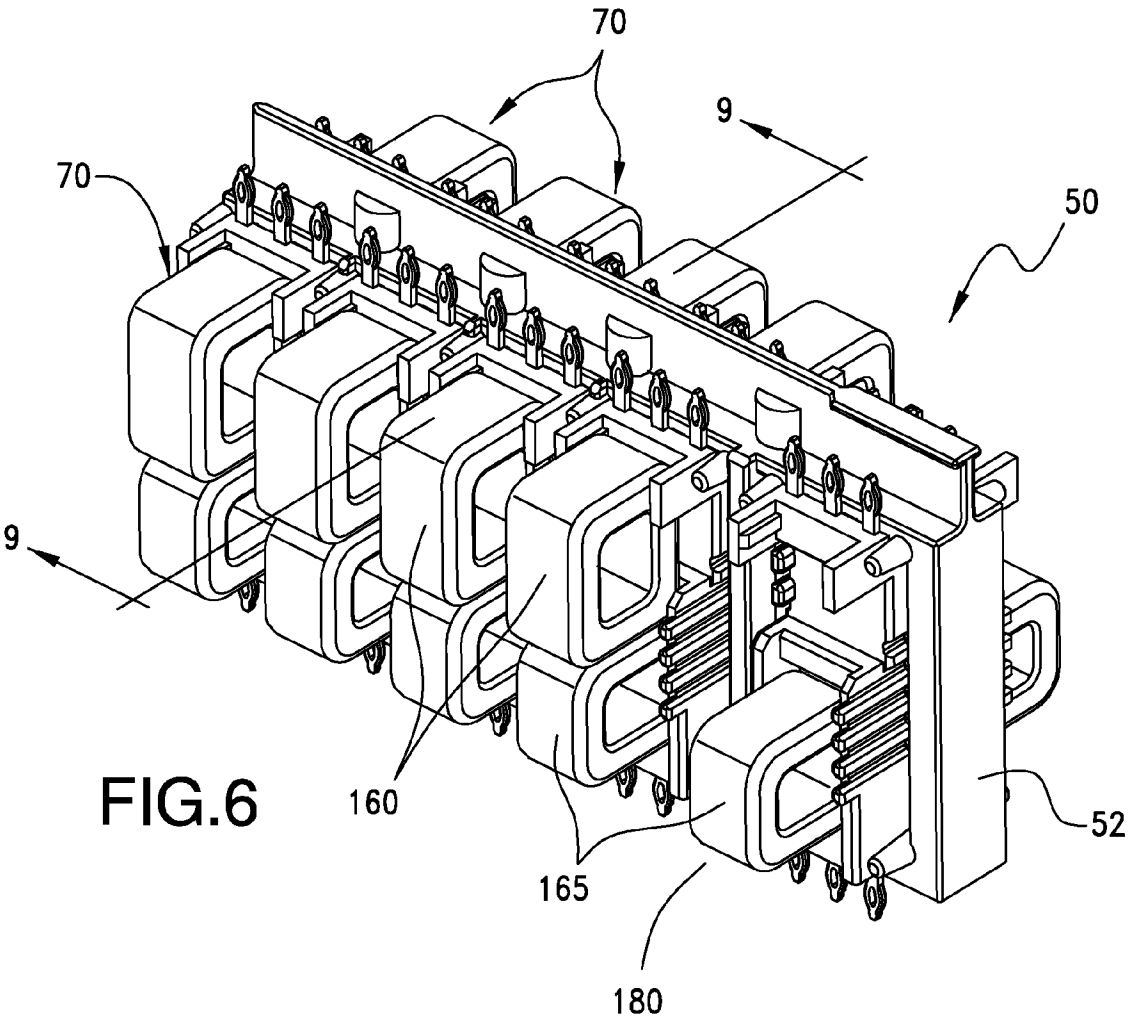
FIG. 6 is a perspective view of a carrier assembly with filtering assemblies mounted on both sides thereof.

As best seen in FIG. 4, the multi-port sub-assembly 40 thus formed is then slid generally in a direction opposite the mating direction "A" and into rear section 35 at the rear face of housing 32. The guide rail 57 of each carrier 52 is aligned with one of the slots 37 in the walls 36 of housing 32 as the multi-port sub-assembly 40 is slid onto the housing 32. Multi-port sub-assembly is retained in a lateral direction by the engagement of guide rails 57 and slots 37. Movement in the vertical direction is controlled by engagement of the forward portion of the contact circuit boards 120 with the housing 32 adjacent the ports 33 and by the engagement of the locking flange 59 towards the rear of carrier 52 with a like-shaped section of slot 38. Referring to FIGS. 3-4, tails 45 are then inserted past the bottom of mounting circuit board 110 and into receptacles 67 in the bottom of center wall 60 so that barb section 46 is secured to the center wall and the board mount compliant section of the tail engages one of the through-holes 111 in the mounting circuit board 110. The shield member 105 is then slid onto the sub-assembly formed by the housing 32 and multi-port sub-assembly 40 and the rear section of the shield member is bent to fully enclose the sub-assembly. The tabs 187 of conductive member 185 extend through slots 108 in the rear wall 109 of the shield member and are bent in order to reduce bowing of the shield member and maintain the position of the tails on the shield member.

Figure 31:
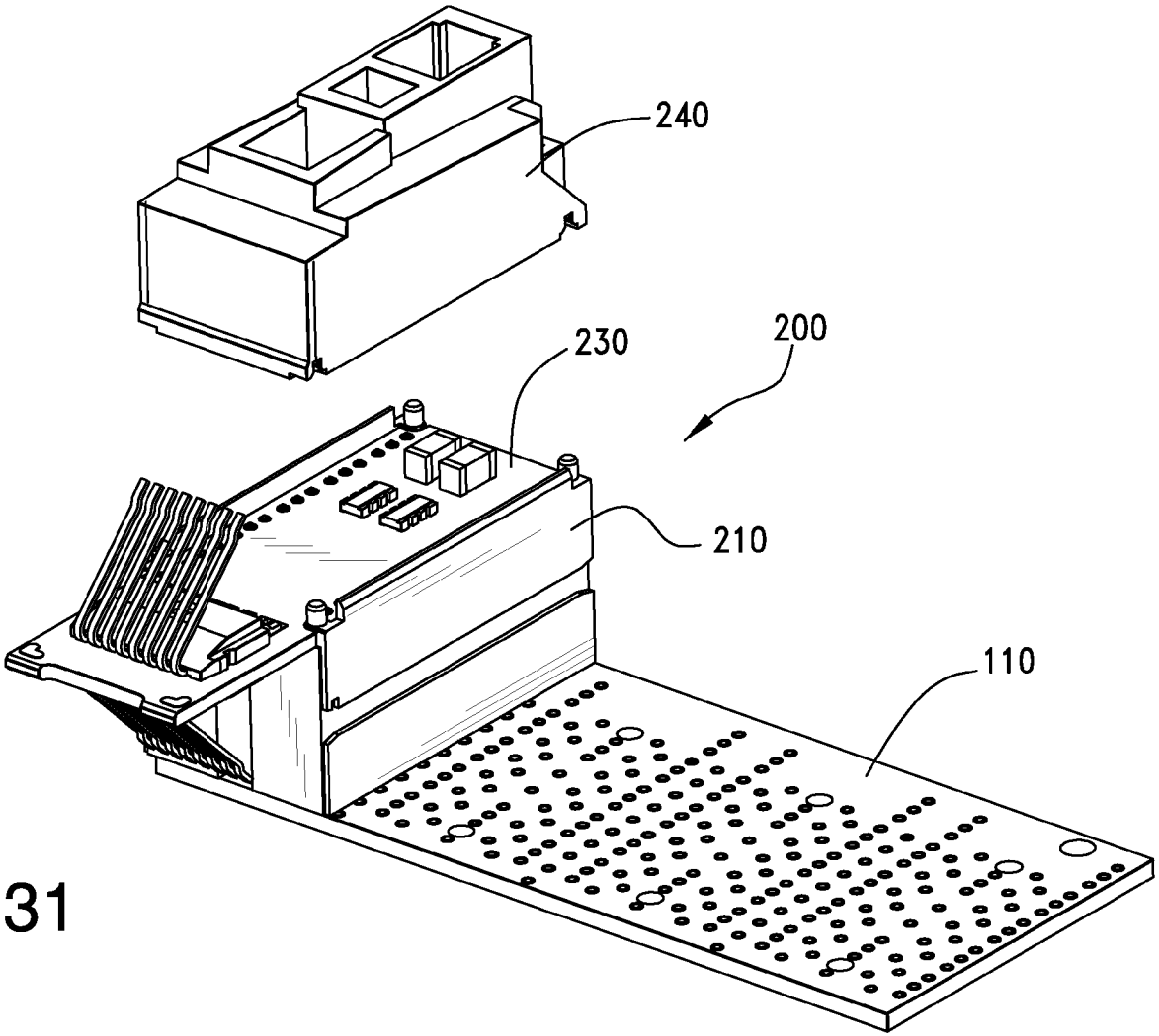
FIG. 31 is a perspective view of a toroid box assembly mounted on a mounting circuit board together with a mounting fixture spaced therefrom.
Figure 32:
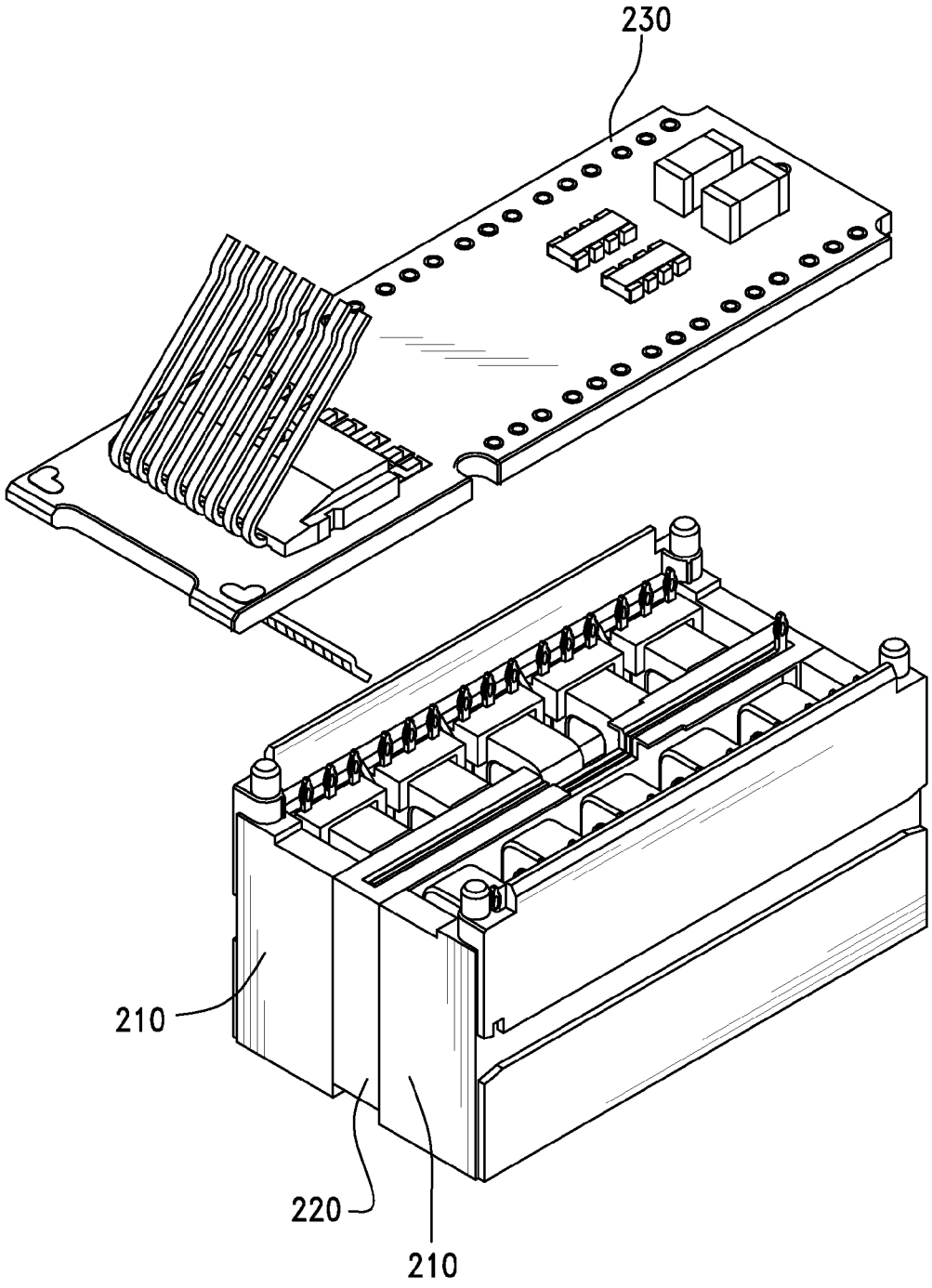
FIG. 32 is a perspective view of the toroid box assembly of FIG. 31 with the contact circuit board spaced therefrom.
Figure 33:
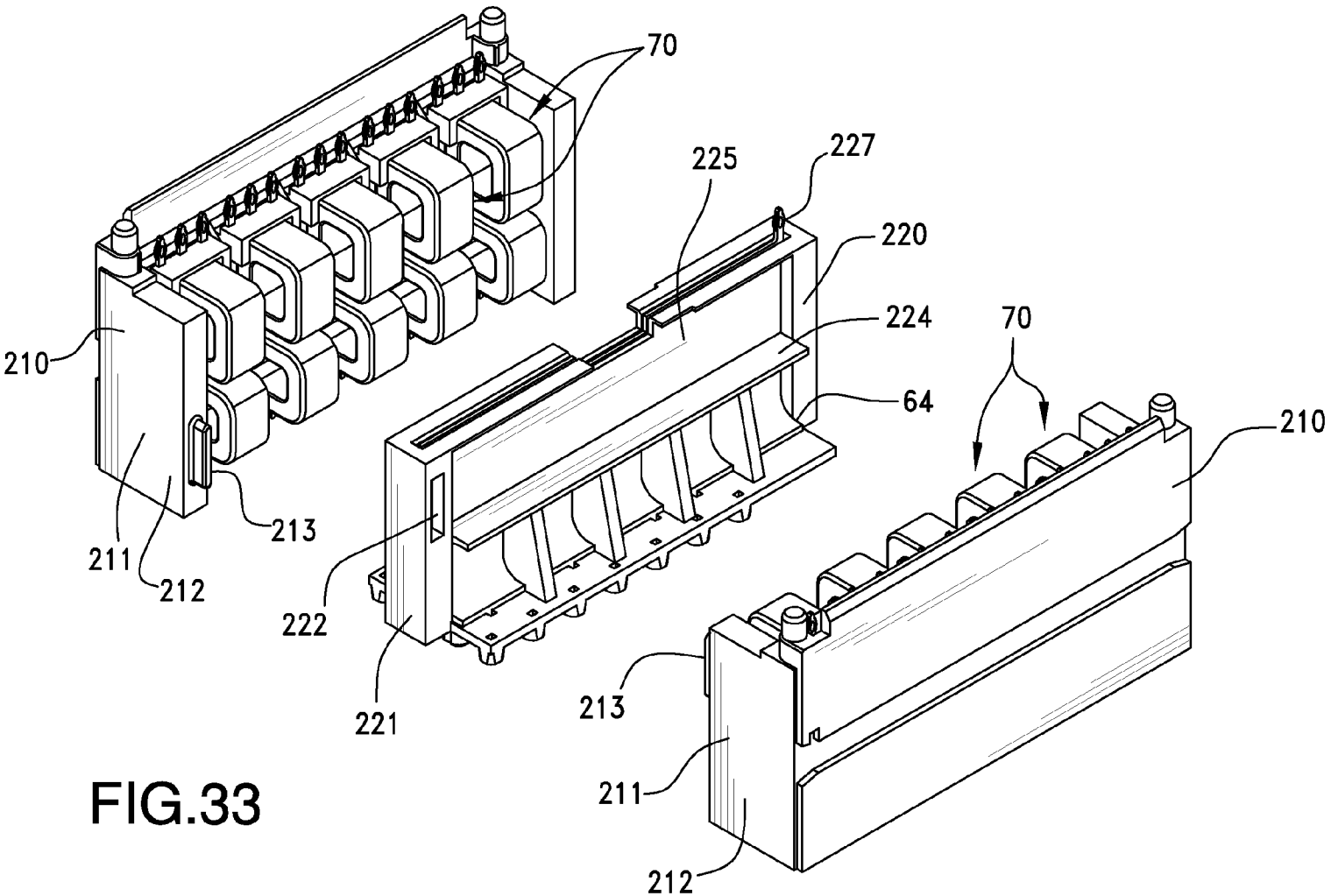
FIG. 33 is an exploded perspective view of a portion of the toroid box assembly of FIG. 32.

Rather than individually mounting carrier assemblies, center walls and contact circuit boards on the mounting circuit board 110 as described relative to the embodiment of FIGS. 1-23, the components may be assembled as a plurality of toroid box assemblies. Like or similar components described with respect to the embodiment of FIGS. 31-33 are identified by identical reference numbers. Toroid box assembly 200 has a pair of carrier assemblies 210 with a center wall 220 therebetween and a contact circuit board 230 positioned on the carrier assemblies.

Each carrier assembly 210 has a generally U-shaped insulative carrier 211 with a filtering assembly receiving face 54 upon which a plurality of filtering assemblies 270 are mounted. Leg sections 212 extend towards and engage end sections 221 of center wall 220 in order to define the perimeter of the toroid box assembly 200. As depicted in FIG. 33, the leg sections 212 may have a projection or post 213 received within an opening or recess 222 in one of the end sections 221 of the center wall 220. The post 213 of one carrier is positioned generally near the bottom of the carrier and the post 213 of the other carrier is positioned generally near the top of the carrier so that the mating the openings 222 on opposite sides of the end sections 221 do not intersect.

As with the embodiment depicted in FIGS. 1-23, the carrier assembly 210 is formed by mounting a plurality of filtering assemblies 270 on a mounting wall 54 of the carrier 211 in the manner described above. It should be noted that each carrier 211 only has one mounting wall 54 so that filtering assemblies 270 are only mounted on one side of the carrier rather than on both sides as depicted relative to carrier 52.

Figure 25:
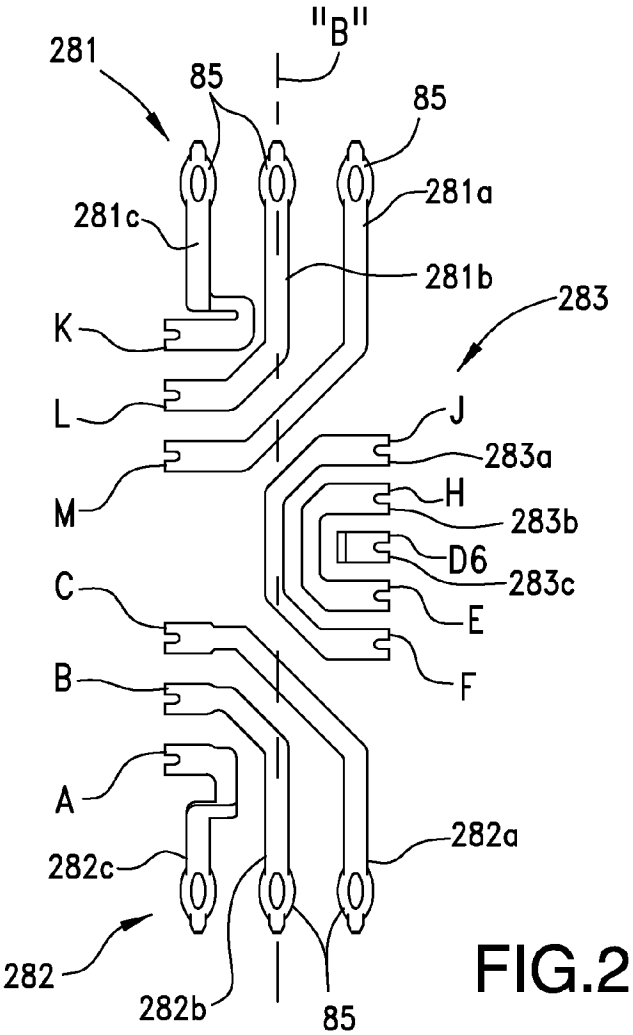
FIG. 25 is a rear elevational view of the terminals within the housing of FIG. 24.
Figure 24:
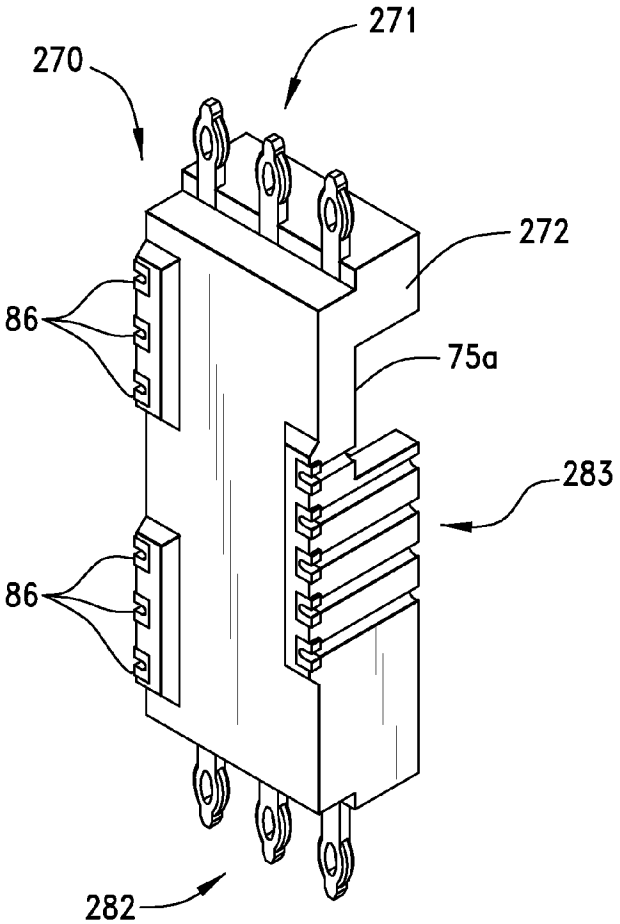
FIG. 24 is a rear perspective view of another embodiment of a filtering assembly with the upper and lower filtering sub-assemblies removed.
Figure 26:
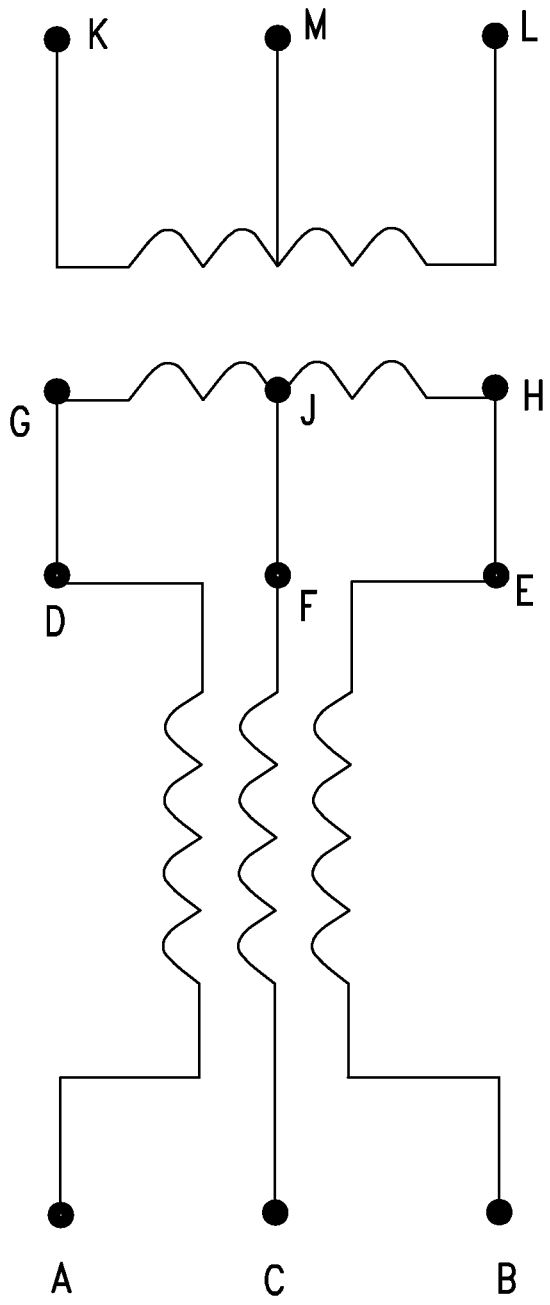
FIG. 26 is a schematic diagram of an embodiment of a filtering assembly.

Each filtering assembly 270 includes a first terminal array 281, a second terminal array 282 and a third terminal array 283 supported by an insulative housing 272. These are depicted in FIG. 25 and schematically in FIG. 26. The first terminal array 281 includes a terminal 281*a* that includes a wire engaging section M, a terminal 281*b* with a wire engaging section L and a terminal 281*c* with a wire engaging section K. The second terminal array 282 includes terminals 282*a*, 282*b*, 282*c* with wire engaging sections C, B, A, respectively. The third terminal array 283 includes terminal 283*a* with wire engaging section J and F, terminal 283*b* with wire engaging section H, E and terminal 283*c* with wire engaging section D. These wire engaging sections are depicted schematically in FIG. 26, which illustrates their functionality.

Center wall 220 is similar in shape and function to center wall 60 of the first embodiment. Center wall 220 includes a plurality of angled projections 64 for separating each of the lower filtering sub-assemblies 90. A central elongated rib 224 extends along the length of the body 225 to separate the upper filtering sub-assemblies 90 from the lower filtering sub-assemblies. A conductive shield 226 may be provided within center wall 220 that extends generally along the length of the center wall. The shield includes an upper terminal 227 configured to engage the contact circuit board 120 and includes one or more lower terminals 228 that extend from a lower surface of the shield and are configured to engage a lower circuit board that supports the toroid box assembly 200. As can be appreciated, the shield 226 includes a body 229 that, as depicted, does not extend the full height of the filtering assemblies 270 so that the body 229 is only aligned with the choke or lower filtering sub-assemblies 91 of the filtering assemblies. It has been determined that in some applications such shielding provides significant performance benefits when configured to only provide shielding adjacent the lower filtering sub-assemblies 90. In some systems, the shielding need not be substantially continuous as depicted and the design of the shield may vary according to the performance requirements of the system.

Toroid box assembly 200 is assembled by mounting a plurality of filtering assemblies 270 on each of the carriers 211 to form the carrier assemblies 210. A first carrier assembly 270 is positioned adjacent center wall 220 so that the post 213 of the carrier is aligned with the opening 222. The center wall 220 is moved relatively towards the carrier assembly 210 and the post 213 is secured within the opening 222 in order to secure the two components together. A second carrier assembly 210 is positioned adjacent center wall 220 on the opposite side of the first carrier assembly with the post 213 of the carrier aligned with the opening 222 of the center wall. The center wall 220 is moved relatively towards the carrier assembly 210 and the post 213 is secured within the opening 222 in order to secure the second carrier assembly to the center wall and create an assembly of two carrier assemblies 210 and the center wall 220. A contact circuit board 120 is then aligned with this assembly so that the plated through-holes 122 of the contact circuit board are aligned with the upper terminal array 81 of each of the carrier assemblies 210. The contact circuit board 120 is moved relatively towards the upper terminal array 81 so that each of the press-fit pins of the board engaging sections 85 of the upper terminal array enter and make an electrical connection with the through-holes of the contact circuit board 120.

The toroid box assembly 200 thus formed may be mounted onto a mounting circuit board 110 by aligning the toroid box assembly with the mounting circuit board and moving the toroid box assembly relatively towards the mounting circuit board. The press-fit pins of the board engaging sections 85 of the lower terminal array 82 of each filtering assembly 70 enter the plated through-holes 111 of the mounting circuit board 110 in order to establish an electrical connection between the toroid box assembly 200 and the mounting circuit board 110. A fixture 240 such as that depicted in FIG. 31 may be used to engage and support the toroid box assembly 200 during the process of mounting the toroid box assembly on the mounting circuit board 110. In the alternative, each toroid box assembly 200 may be mounted on an individual circuit board (not shown) rather than a plurality of the toroid box assemblies being mounted on a single mounting circuit board.

Figure 34:
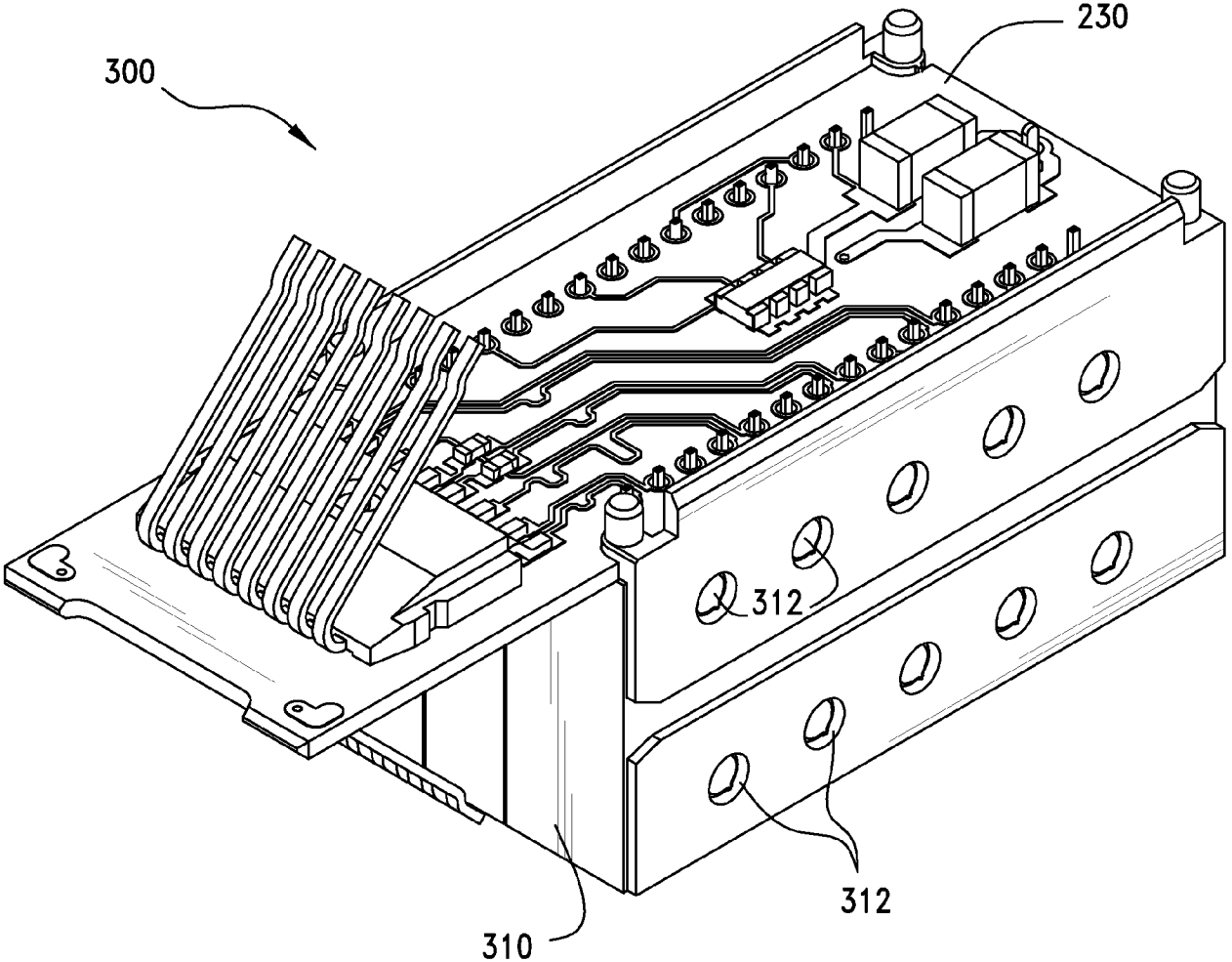
FIG. 34 is a perspective view of another alternate embodiment of a toroid box assembly.
Figure 35:
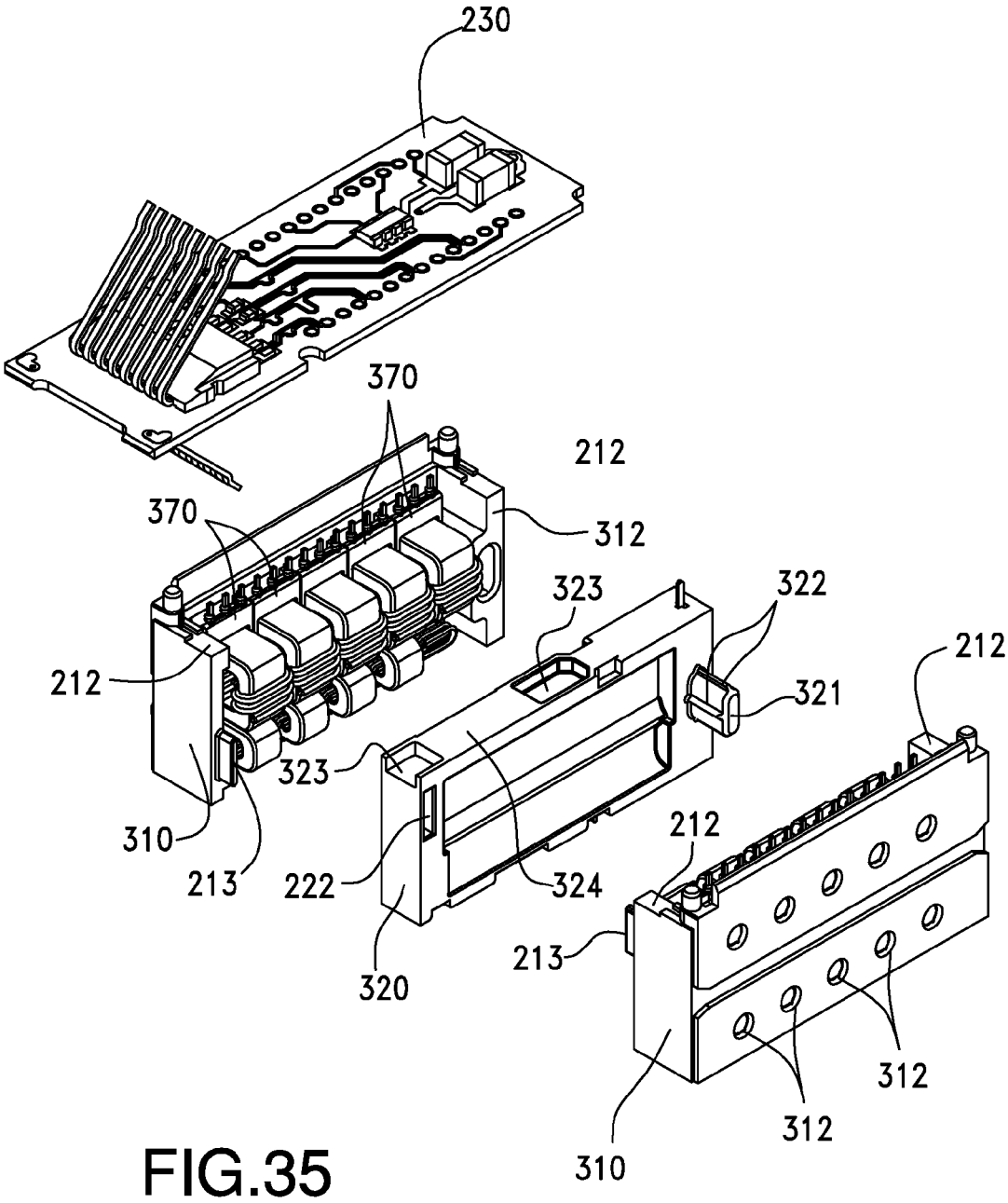
FIG. 35 is a partially exploded perspective view of the toroid box assembly of FIG. 34.
Figure 36:
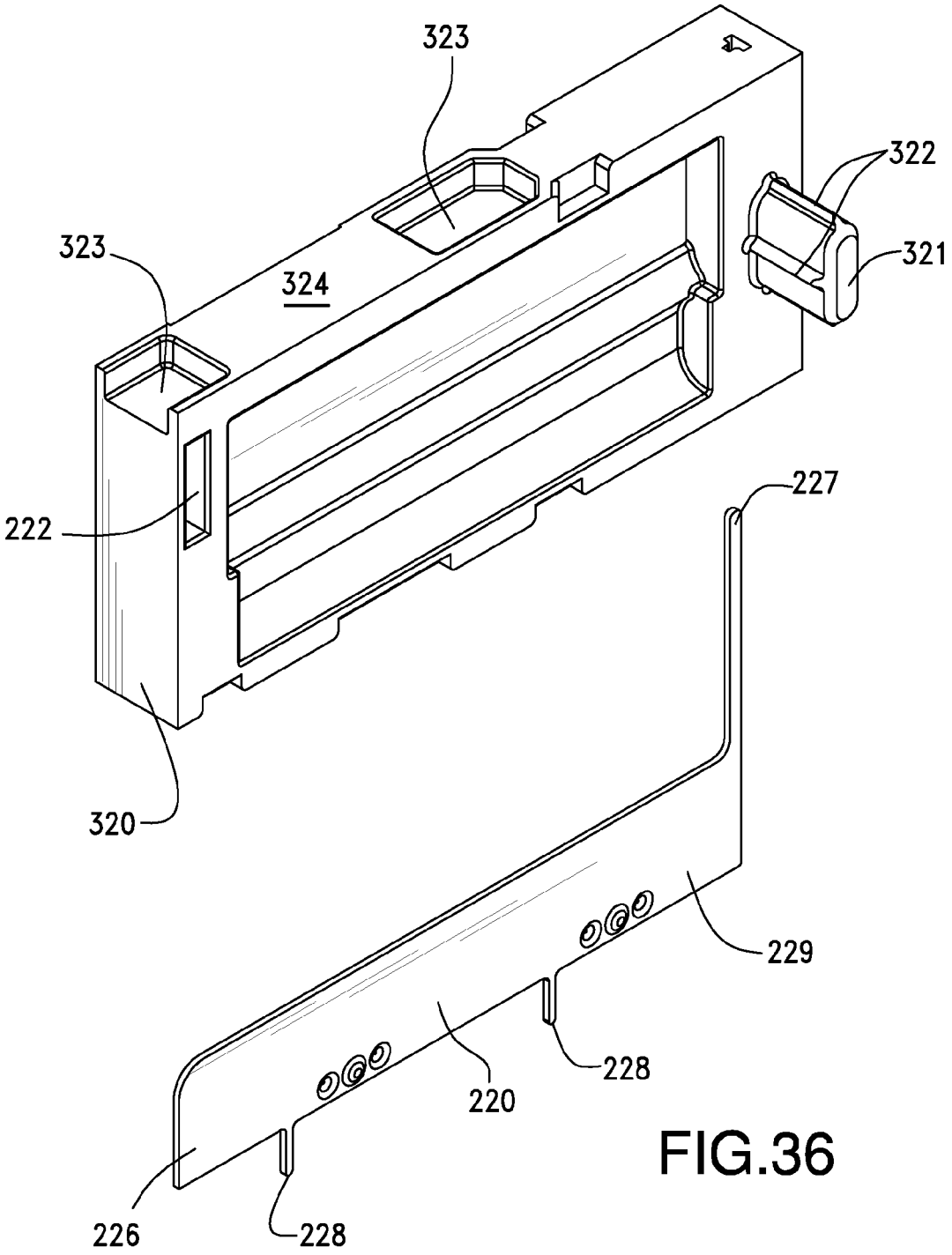
FIG. 36 is an exploded perspective view of the center wall and ground member of the toroid box assembly of FIG. 35.

Referring to FIG. 34, still another alternate structure of a toroid box assembly 300 is depicted. The toroid box assembly 300 is similar to the toroid box assembly 200 depicted in FIGS. 31-33. Like or similar components are identified by identical reference numbers. Carrier assemblies 310 include a plurality of filtering assemblies 370 mounted on a pair of carrier 311. Each of the filtering assemblies 370 includes one or more projections 371 with crush ribs 372 that are press-fit into circular openings 312 in the carriers. The carrier assemblies 310 are secured to the center wall 320 at one end with posts 213 of carrier 311 that are vertically offset and are received within openings 222 in center wall 330. At the opposite end, an alternate structure is provided for securing the carrier assemblies 310 to the center wall 320. A generally oval post 321 with crush ribs 322 extends laterally from each side of the center wall 320. Each post 321 is received in a recess 312 in the end of the leg sections 212 of the carriers 311 in order to secure the carrier assemblies 311 to the center wall 320. Recesses 323 may be provided in the upper surface 324 of center wall 320 in order to provide relief for components (not shown) that may be mounted on the lower surface of contact circuit.

Figure 30:
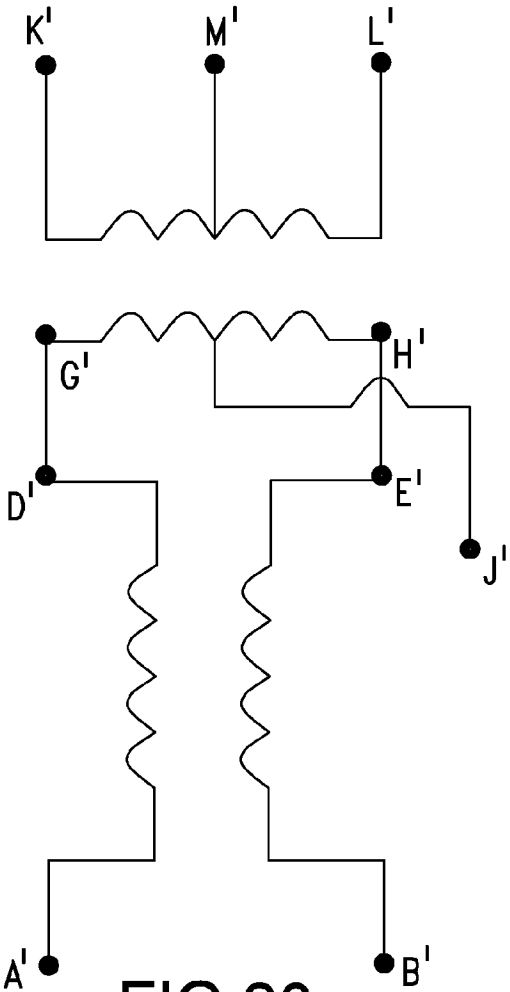
FIG. 30 is a schematic diagram of an embodiment of a filtering assembly depicted in FIG. 29.
Figure 29:
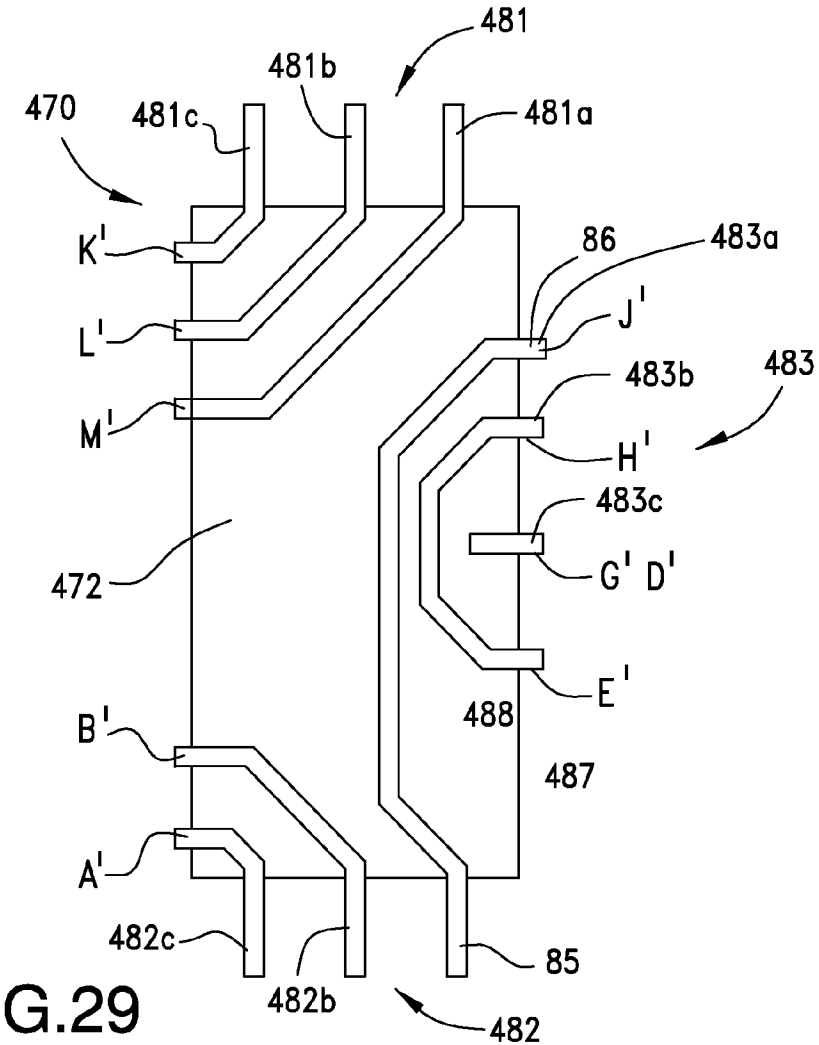
FIG. 29 is a a is a schematic representation of an embodiment of a filtering assembly.

Referring to FIGS. 29-30, an alternate embodiment of a filtering assembly 470 is schematically depicted. Filtering assembly 470 is similar to filtering assembly 70 but has terminals configured in a different pattern. Like or similar components as compared to filtering assembly 70 are identified by identical reference numbers. Filtering assembly 470 has an insulative housing 472 with a plurality of conductive terminals 480 defining three terminal arrays 481, 482, 483. The upper terminal array 481 is generally identical to the upper terminal array 81 of filtering assembly 70. Lower terminal array 482 is similar to the lower terminal array 82 of filtering assembly 70 but is rotated 180 degrees about the longitudinal axis "B" of filtering assembly 470. As a result, the wire engaging sections 86 of each terminal of the lower terminal array 482 extend in the same direction as the wire engaging sections of each terminal of the upper terminal array 482. In addition, the first terminal 482*a* is the longest of the lower terminal array while the third terminal 482*c* is the shortest which is reversed as compared to the lower terminal array 82 of filtering array 70.

The wire engaging sections 86 of the intermediate terminal array 483 of filtering assembly 470 extend generally perpendicularly to longitudinal axis "B" but in a direction opposite the wire engaging sections 86 of both the upper and lower terminal arrays 481, 482. Upper terminal array 481 includes terminal 481*a*, 481*b* and 481*c* while lower terminal array 482 includes terminals 482*a*, 482*b* and 482*c*. The intermediate terminal array 483 includes first nested generally U-shaped terminal 483*b*. The U-shaped terminal 483*a* has a wire engaging section 86 at both ends thereof. Unlike the embodiment depicted in FIG. 25, however, the centertap terminal 483*a* is not connected to a conductor that passes through the choke and instead is configured to terminate directly to a mounting circuit board. The third terminal 483*c* of the intermediate terminal array 483 is generally similar to the terminals of the intermediate terminal array 83 of the filtering assembly 70. Filtering assembly 470 is assembled in substantially the same manner as filtering assembly 70 but the conductors that are connected to the first and second terminals 483*a*, 483*b* are each connected to their own wire engaging section 86 rather than being inserted into a wire engaging section configured to receive two conductors therein. FIG. 30 schematically illustrates how the wire engaging sections A', B', C', D', E', G', H', J', K', L', M', which are depicted in FIG. 29, function.

Figure 28:
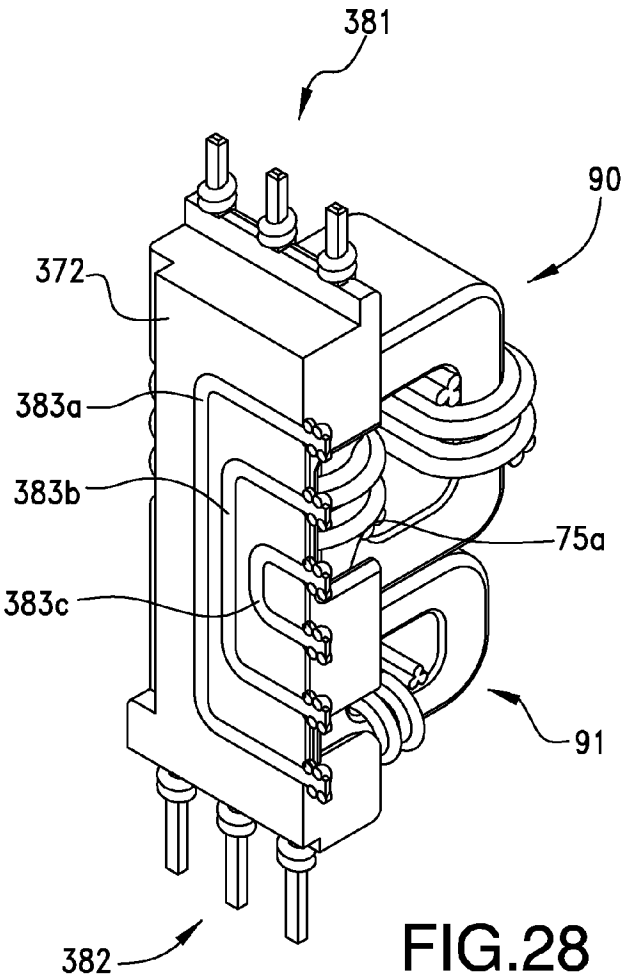
FIG. 28 is a section taken along line 28-28 of FIG. 27.
Figure 27:
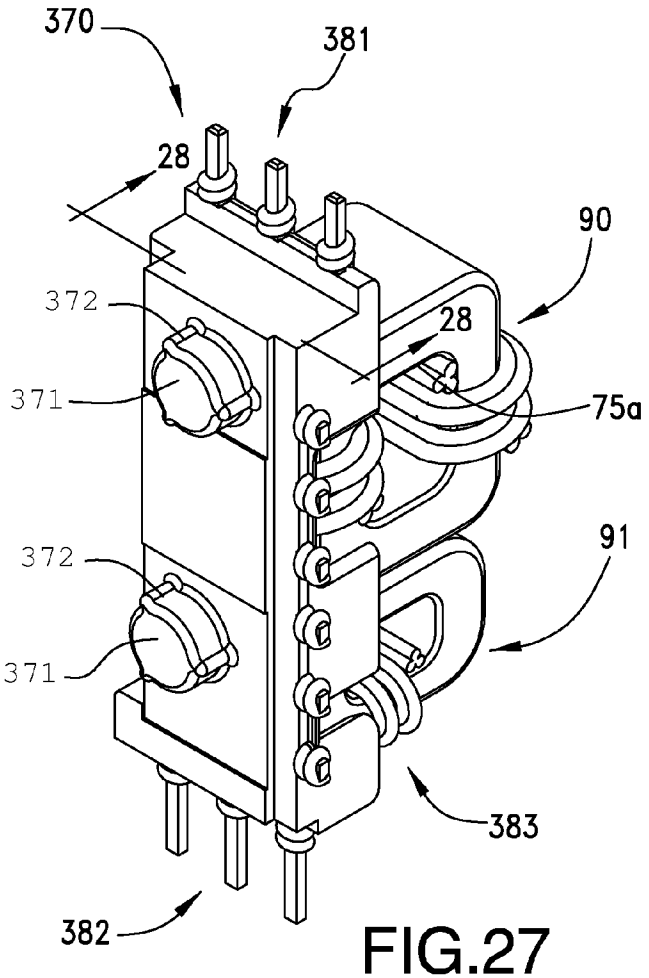
FIG. 27 is a rear perspective view of another embodiment of a filtering assembly.

Another alternate embodiment of a filtering assembly 370 is depicted in FIGS. 27-28. Like or similar components as compared to filtering assembly 470 are identified by identical reference numbers. Filtering assembly 370 is similar to filtering assembly 470 but has wire engaging sections 386 configured to have the conductors of the upper and lower filtering assemblies wrapped or wound around the wire engaging sections and subsequently soldered thereto. In addition, the board engaging sections 385 are configured to be soldered to circuit boards rather than being configured with a press-fit section for a solderless connection. It should be noted that while wires are depicted as being wound around the cores 160, 165 of filtering assembly 370 and terminals 481, 482, 483, such windings are not complete and thus do not accurately depict a typical wire wrapping construction.

Although the disclosure provided has been described in terms of illustrated embodiments, it is to be understood that the disclosure is not to be interpreted as limiting. Various alterations and modifications will no doubt become apparent to those skilled in the art after having read the above disclosure. For example, aspects of the illustrated embodiments could be utilized with electrical connectors other than magnetic jacks. Numerous other embodiments, modifications and variations within the scope and spirit of the appended claims will occur to persons of ordinary skill in the art from a review of this disclosure.

The invention claimed is:

1. A filtering assembly comprising:

an insulative housing block including a plurality of conductive terminals defining a first terminal array, a second terminal array and a third terminal array, the first terminal array having a first set of board engaging sections and the second terminal array having a second set of board engaging sections, the first set of board engaging sections extending in a first direction and the second set of board engaging sections extending in a second direction, the second direction being different than the first direction; and first and second filtering sub-assemblies mounted on the housing block, the first filtering sub-assembly including a first core with first and second conductors wound therearound, the first conductor being electrically connected to the first terminal array, the second conductor being electrically connected to the third terminal array, and the first and second conductors being magnetically coupled to each other, the second filtering sub-assembly including a second core with third and fourth conductors wound therearound, the third and fourth conductors electrically connecting conductive terminals of the second terminal array to conductive terminals of the third terminal array.

2. The filtering assembly of claim 1, further including a first centertap conductor electrically connected to the first conductor and to a conductive terminal of the first terminal array, a second centertap conductor electrically connected to the second conductor and to a centertap conductive terminal of the third terminal array.

3. The filtering assembly of claim 2, further including a fifth conductor electrically connecting a conductive terminal of the second terminal array to the centertap conductive terminal of the third terminal array.

4. The filtering assembly of claim 1, wherein the first filtering sub-assembly is a transformer and the second filtering sub-assembly is a choke.

5. The filtering assembly of claim 1, wherein each of the conductive terminals of the first and second terminal arrays is a non-linear member.

6. The filtering assembly of claim 1, wherein a portion of each conductive terminal is embedded in the insulative housing block.

7. The filtering assembly of claim 1, wherein each of the conductive terminals has a wire engaging section to which one of the conductors is soldered.

8. The filtering assembly of claim 7, wherein the wire engaging sections of the first terminal array are in a first row, the wire engaging sections of the second terminal array are in a second row, and the first and second rows are generally co-linear.

9. The filtering assembly of claim 8, wherein the wire engaging sections of the third terminal array are in a third row, the third row being generally parallel to and spaced from a line through the first and second rows.

10. The filtering assembly of claim 7, wherein all of the wire engaging sections are in a common plane.

11. The filtering assembly of claim 10, wherein the conductive terminals of the first and second terminal arrays include a circuit member engaging section and all of the circuit member engaging sections are spaced from the common plane.

12. The filtering assembly of claim 1, wherein the first and second direction are opposite directions.

13. A modular jack, comprising:

a housing having a mating face and a plurality of jack openings, each jack opening including a plurality of contacts and being configured to receive a mateable connector; and a plurality of filtering assemblies as defined in claim 1, wherein each filtering assembly is electrically connected to the contacts of one of the jack openings.

14. The modular jack of claim 13, further comprising a contact circuit board with a plurality of traces coupled to the first terminal arrays of the plurality of filtering assemblies, the contact circuit board supporting the plurality of contacts.

15. The modular jack of claim 14, wherein the housing is further mounted on a mounting circuit board.

16. A filtering assembly comprising:

an insulative housing block including a plurality of conductive terminals defining a first terminal array and a second terminal array, the first terminal array having a first set of board engaging sections and the second terminal array having a second set of board engaging sections, the first set of board engaging sections extending in a first direction and the second set of board engaging sections extending in a second direction, the second direction being different than the first direction; and a plurality of filtering sub-assemblies mounted on the housing block, each filtering sub-assembly including a first core with first and second conductors wound therearound, the first and second conductor being electrically connected to the first terminal array and a third and fourth conductor being magnetically coupled to the first and second conductor and electrically connected to the second terminal array, the first and second conductor being electrically isolated from the third and fourth conductor.

17. The filtering assembly of claim 16, wherein the plurality of filtering sub-assemblies further include a second core, the first core configured to function as a transformer and the second core configured to function as a choke.

18. The filtering assembly of claim 17, wherein the first and second core have a first and second sidewall, the first and second sidewall positioned on opposite sides of the cores and the cores further include at least one flat abutting surface.

19. A modular jack, comprising:

a housing having a mating face and a plurality of jack openings, each jack opening including a plurality of contacts and being configured to receive a mateable connector; and a plurality of filtering assemblies as defined in claim 16, wherein each filtering assembly is electrically connected to the contacts of one of the jack openings.

20. The modular jack of claim 19, wherein the housing is mounted on a mounting circuit board.

21. A modular jack comprising:

a housing having a mating face and a plurality of jack openings therein, each jack opening including a plurality of contacts and being configured to receive a mateable connector;

a plurality of filtering assemblies, each filtering assembly being electrically connected to the contacts of one of the jack openings, each filtering assembly including a plurality of electrically conductive terminals and a filtering sub-assembly including a plurality of conductors, a first set of the conductors being electrically connected to a first array of the electrically conductive terminals, a second set of the conductors being electrically connected to a second array of the electrically conductive terminals, and at least some of the first set of conductors being magnetically coupled to and electrically isolated from at least some of the second set of conductors; and a circuit board electrically connected to each second array of the electrically conductive terminals, the circuit board having a plurality of electrically conductive tails mounted thereon configured to make a press-fit electrical connection with conductive traces of another circuit board.

22. The modular jack of claim 21, wherein each electrically conductive tail has first and second spaced apart resilient board engaging sections, the first board engaging section engaging a conductive trace of the circuit board and the second board engaging section being configured to engage one of the conductive traces of the another circuit board.

23. The modular jack of claim 22, wherein each terminal of the second array of electrically conductive terminals is press-fit into the circuit board to make an electrical connection therewith.

24. The modular jack of claim 23, wherein each terminal of the first array of electrically conductive terminals is press-fit into a contact circuit board to make an electrical connection therewith.

25. The modular jack of claim 24, wherein the contacts of a pair of aligned jack openings are mounted on each contact circuit board.

26. The modular jack of claim 23, wherein each terminal of the second array of electrically conductive terminals and the electrically conductive tails of the circuit board project from the circuit board in generally opposite directions.

27. The modular jack of claim 23, wherein each terminal of the second array of electrically conductive terminals and the electrically conductive tails of the circuit board are configured to be inserted into the circuit board from generally opposite directions.

* * * * *